US012276009B2

(12) United States Patent
Beals

(10) Patent No.: US 12,276,009 B2
(45) Date of Patent: Apr. 15, 2025

(54) PROCESS FOR LOW-COST TEMPERING OF ALUMINUM CASTING

(71) Applicant: MAGNA INTERNATIONAL INC., Aurora (CA)

(72) Inventor: Randolf Scott Beals, Grand Ledge, MI (US)

(73) Assignee: MAGNA INTERNATIONAL INC., Aurora (CA)

( * ) Notice: Subject to any disclaimer, the term of this patent is extended or adjusted under 35 U.S.C. 154(b) by 449 days.

(21) Appl. No.: 17/712,526

(22) Filed: Apr. 4, 2022

(65) Prior Publication Data

US 2022/0228242 A1 Jul. 21, 2022

Related U.S. Application Data

(62) Division of application No. 16/487,877, filed as application No. PCT/US2018/019432 on Feb. 23, 2018, now abandoned.

(60) Provisional application No. 62/462,598, filed on Feb. 23, 2017.

(51) Int. Cl.

| | |
|---|---|
| ***B22D 7/00*** | (2006.01) |
| ***B22D 11/00*** | (2006.01) |
| ***B22D 31/00*** | (2006.01) |
| ***C22C 21/02*** | (2006.01) |
| ***C25D 5/44*** | (2006.01) |
| ***C25D 5/50*** | (2006.01) |
| ***C25D 9/02*** | (2006.01) |

(52) U.S. Cl.

CPC ..... *C22C 21/02* (2013.01); *B22D 7/00* (2013.01); *B22D 11/003* (2013.01); *B22D 31/00* (2013.01); *C25D 5/44* (2013.01); *C25D 5/50* (2013.01); *C25D 9/02* (2013.01)

(58) Field of Classification Search

CPC ..... B22D 7/00; B22D 31/00; C22C 21/02
USPC ..... 164/47, 75, 76.1
See application file for complete search history.

(56) References Cited

U.S. PATENT DOCUMENTS

| | | | | |
|---|---|---|---|---|
| 5,463,804 | A | 11/1995 | McCleary et al. | |
| 6,419,769 | B1 * | 7/2002 | Lee et al. | C22F 1/043 148/698 |
| 8,662,141 | B2 | 3/2014 | Carlson et al. | |
| 2004/0265163 | A1 | 12/2004 | Doty | |
| 2005/0163647 | A1 | 7/2005 | Donahue et al. | |
| 2005/0167012 | A1 | 8/2005 | Lin | C22C 21/04 148/549 |
| 2006/0225688 | A1 * | 10/2006 | Ward et al. | F02F 1/18 123/193.2 |
| 2007/0240796 | A1 * | 10/2007 | Koch et al. | C22C 21/08 420/544 |
| 2008/0318081 | A1 | 12/2008 | Steins | |
| 2010/0286791 | A1 | 11/2010 | Goldsmith | |
| 2015/0071815 | A1 | 3/2015 | Wiesner | C22C 21/04 420/532 |
| 2017/0044650 | A1 | 2/2017 | Harrison | C22F 1/002 |
| 2019/0119792 | A1 * | 4/2019 | Wiesner | C22C 21/08 |
| 2021/0040582 | A1 * | 2/2021 | Bitton | B22D 11/08 |

FOREIGN PATENT DOCUMENTS

| | | |
|---|---|---|
| CN | 204572683 U | 8/2015 |
| CN | 106381421 A | 2/2017 |

OTHER PUBLICATIONS

Supplemental European Search Report corresponding to Application No. EP 18756703.7 dated Aug. 19, 2020.

Jack Vann, "Oct. 2008 Jurgen Wüst", Jan. 1, 2011 (Jan. 1, 2011), XP055723285, Retrieved from the Internet URL:http://www.visitrak.com/Media/High-Q-Cast-NADCA-2011.pdf, [retrieved on Aug. 18, 2020], * pp. 42,52 * [retrieved on Aug. 18, 2020],, * pp. 42, 52 *.

Martin Hartlieb: "Introduction", May 1, 2013 (May 1, 2013), XP055723296, Retrieved from the Internet: URL:https://mercalloy.com/site media/pdfs/ NADCA—Aluminum Alloys for Structural Die CastTng.pdf—Tretrieved on Aug. 18, 2020], * the whole document*.

Jarco, A. et al.; Impact of Various Types of Heat Treatment on Mechanical Properties of the EN AC-AlSi6Cu4 Alloy; Archives of Foundry Engineering; Special Issue Feb. 2015; vol. 15; pp. 35-38.

Hu, Ji-Ming et al.; Electrodeposition of silane films on aluminum alloys for corrosion protection; Progress in Organic Coatings; Jan. 4, 2007; vol. 58; pp. 265-271.

Machine Translation of CN 106381421 A (Year: 2017).

* cited by examiner

*Primary Examiner* — Kevin P Kerns
(74) *Attorney, Agent, or Firm* — Dickinson Wright PLLC

(57) ABSTRACT

A thermally stable component formed of a tempered aluminum alloy casting which reduced costs is provided. The aluminum alloy typically has an elongation of at least 8% after casting, which is preferred for self-piercing rivet processes. The aluminum alloy leaves a casting facility in the as-cast (F temper) condition. The cast aluminum alloy is then shipped to another entity, such as an OEM, and is subjected to an artificial aging process, such as on the OEM's existing paint line, rather than at the casting facility. The artificial aging process typically includes electrodeposition coating and curing. The components that can be formed by the reduced cost method include lightweight automotive vehicle components, including structural, body-in-white, suspension, or chassis components, such as front shock towers, front body hinge pillars, tunnels, and rear rails.

17 Claims, 22 Drawing Sheets

2.8 mm

| (Ave.) | YS | UTS | %Elong |
|---|---|---|---|
| F temp | 125 | 269 | 13.7 |
| Nat Age 1 mth | 126 | 270 | 12.8 |

| MS | UTS | YS | % Elong |
|---|---|---|---|
| 1 hour | 262 | 122 | 11.83 |
| 1 day | 272 | 129 | 12.7 |
| 2 days | 269 | 131 | 11.1 |
| 4 days | 269 | 133 | 11.15 |
| 7 days | 271 | 131 | 11.2 |
| 14 days | 274 | 133 | 11.15 |
| 21 days | 273 | 128.8 | 11.2 |

2.8 mm

| (Ave.) | YS | UTS | %Elong |
|---|---|---|---|
| F | 125 | 269 | 13.7 |
| T85 (Paint Bake) | 149 | 272 | 9.6 |

F temper

| (ave.) | YS | UTS | % Elong |
|---|---|---|---|
| OEM 2 (2.8 mm) | 125 | 269 | 13.7 |
| OEM 2 (4.0 mm) | 119 | 265 | 15.9 |
| OEM 3 (Door Inner) | 127 | 265 | 12.5 |
| OEM 3 Rear Shock Tower) | 123 | 259 | 11.4 |
| OEM 3 Rear Cross Beam | 121 | 264 | 12 |

Final temper

| (ave.) | YS | UTS | % Elong |
|---|---|---|---|
| OEM 2 (2.8 mm) T85 | 125 | 269 | 13.7 |
| OEM 2 (4.0 mm) T85 | 119 | 265 | 15.9 |
| OEM 3 (Door Inner) T5 | 127 | 265 | 12.5 |
| OEM 3 Rear Shock Tower) T5 | 123 | 259 | 11.4 |
| OEM 3 Rear Cross Beam T5 | 121 | 264 | 12 |

PROCESS FOR LOW-COST TEMPERING OF ALUMINUM CASTING

CROSS REFERENCE TO RELATED APPLICATIONS

This U.S. Divisional Patent Application claims the benefit of U.S. National Stage patent application Ser. No. 16/487,877 filed Aug. 22, 2019, now abandoned, which claims the benefit of PCT International Patent Application Serial No. PCT/US2018/019432 filed Feb. 23, 2018, which claims the benefit of U.S. Provisional Patent Application Ser. No. 62/462,598 filed Feb. 23, 2017, the entire disclosure of the applications being considered part of the disclosure of this application, and hereby incorporated by reference.

BACKGROUND OF THE INVENTION

1. Field of the Invention

The invention relates generally to a tempered aluminum alloy casting, a method of forming the tempered aluminum alloy casting, an automotive vehicle component formed of the tempered aluminum alloy casting, and a method of manufacturing the component.

2. Related Art

Tempered aluminum alloy castings are oftentimes used in the automotive industry to form lightweight components, including complex structural, body-in-white, suspension, and chassis components. Oftentimes, it is desirable to use cast aluminum alloys having an elongation of at least 8%, for example when the cast aluminum alloy is subjected to a self-piercing rivet (SPR) process. A cast aluminum alloy having an elongation of at least 9 to 10% can be achieved by an aluminum alloy known as "Aural 2" in the heat treated T7 condition. However, when this type of aluminum alloy is used, the tempering process typically requires a T7 heat treatment cycle, solution heat treating, air quenching, straightening with a coining, and artificial aging. Thus, the use of the Aural 2 alloy and the associated process is limited due to the cost of the operations. It is desirable to achieve an aluminum alloy casting having a minimum elongation of 8%, before any heat treatment or paint oven exposure of the cast aluminum alloy, which can be subjected to self-piercing rivets, and a less costly tempering process.

SUMMARY

One aspect of the invention provides an aluminum alloy, comprising: silicon in an amount of 4.0 to 9.0 weight percent (wt. %), copper in an amount up to 0.10 wt. %, iron in an amount up to 0.25 wt. %, manganese in an amount of 0.3 to 0.60 wt. %, magnesium in an amount of 0.10 to 0.60 wt. %, titanium in an amount up to 0.15 wt. %, strontium in an amount of 0.01 to 0.60 wt. %, and a balance of aluminum, except for possible incidental elements and/or impurities, based on the total weight of the aluminum alloy. The aluminum alloy is cast, and a coating is applied to the aluminum alloy.

Another aspect of the invention provides a method of manufacturing a cast aluminum alloy. The method comprises the steps of: casting an aluminum alloy, the aluminum alloy including silicon in an amount of 4.0 to 9.0 weight percent (wt. %), copper in an amount up to 0.10 wt. %, iron in an amount up to 0.25 wt. %, manganese in an amount of 0.3 to 0.60 wt. %, magnesium in an amount of 0.10 to 0.60 wt. %, titanium in an amount up to 0.15 wt. %, strontium in an amount of 0.01 to 0.60 wt. %, and a balance of aluminum, except for possible incidental elements and/or impurities, based on the total weight of the aluminum alloy: applying a coating to the cast aluminum alloy; and heating the coated cast aluminum alloy.

BRIEF DESCRIPTION OF THE DRAWINGS

Other advantages of the present invention will be readily appreciated, as the same becomes better understood by reference to the following detailed description when considered in connection with the accompanying drawings wherein.

DESCRIPTION OF EXAMPLE EMBODIMENTS

Figure 1:
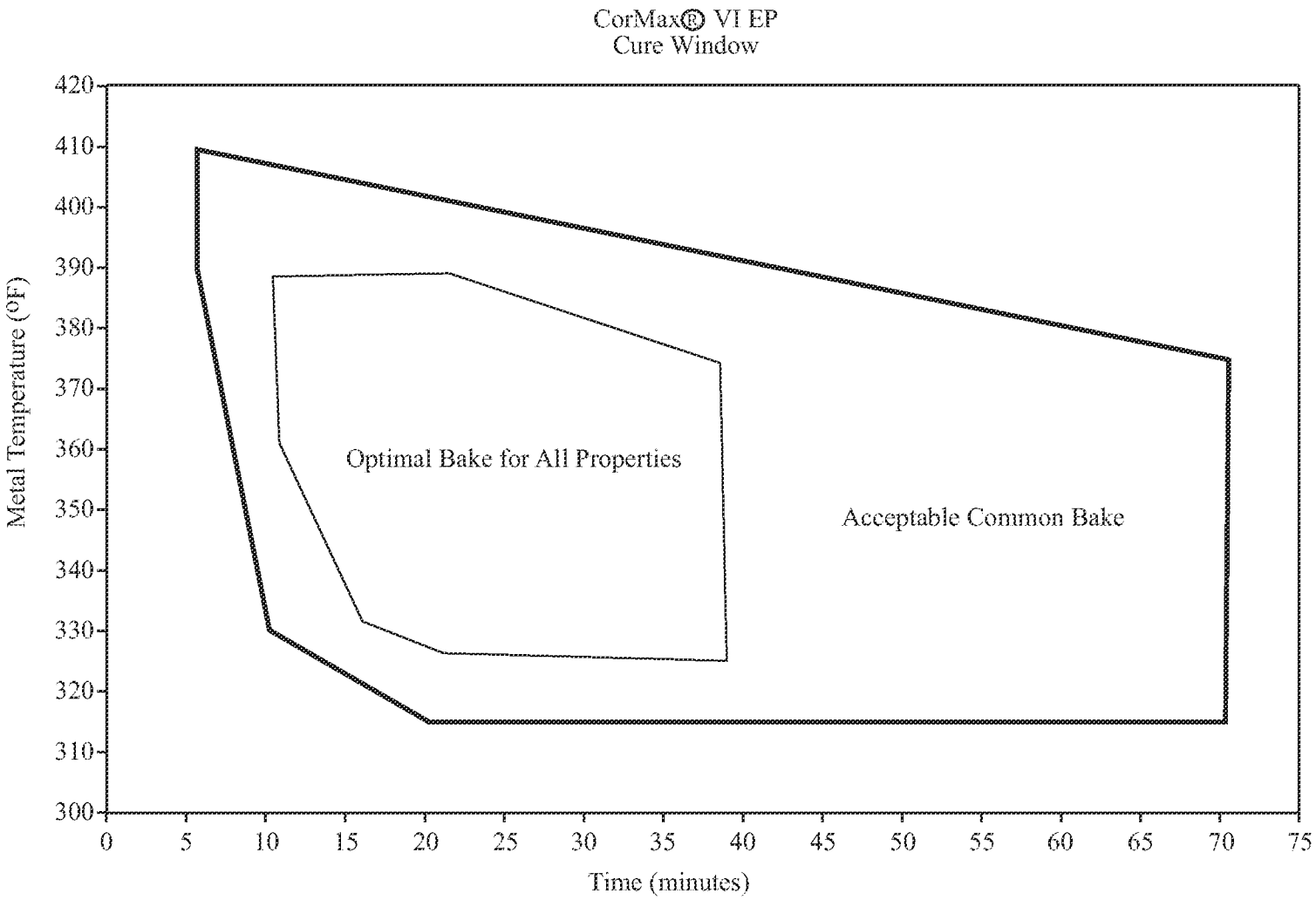
FIG. 1 is a graph of a curing window for an example electrodeposition coating which can be applied to an aluminum casting according to an example embodiment.

One aspect of the invention provides a tempered aluminum alloy casting, and a thermally stable component formed of the tempered aluminum alloy casting. Another aspect of the invention includes a method of manufacturing the tempered aluminum alloy casting, and a thermally stable component formed of the tempered aluminum alloy casting. Typically, the aluminum alloy has an elongation of at least 8%, or at least 9 to 10% after casting (F temper condition), which can be tested according to the ASTM E8 tensile testing specification, and the cast aluminum alloy is then subjected to an artificial aging (T5) process. The F temper condition is with no heat treatment. The T5 process includes cooling from an elevated temperature shaping process then artificially aging.

The aluminum alloy preferably leaves a casting facility or foundry in the as-cast (F temper) condition with an elongation of at least 8% or at least 10%, when tested according to the ASTM E8 specification, which is the preferred minimum elongation for next subjecting the cast aluminum alloy to a self-piercing rivet (SPR) process. The cast aluminum alloy can then be shipped to another entity or manufacturer, such as an OEM or customer. The artificial aging process on the cast aluminum alloy can be conducted at the OEM or customer's facility, for example on the OEM's paint line and/or at an ecoat sub-supplier and then shipped to an OEM, depending on the corrosion strategy for the component, rather than at the casting facility. The components that can be formed from the tempered aluminum alloy castings include lightweight automotive vehicle components. Examples of the components include structural, body-in-white, suspension, or chassis components or components, such as, but not limited to, a front shock tower, front body hinge pillar, tunnel, rear rail, door inner panel, door mirror bracket, cross car beam, inner and outer torque boxes, rear shock mount, etc.

The method used to form the component using the tempered aluminum alloy casting is typically less costly than a comparative method which includes a T7 heat treatment cycle. The comparative T7 heat treatment cycle includes solution heat treating for 60 minutes at 860° F. (460° C.)) of the Aural 2 or C65K aluminum alloy, air quenching the aluminum alloy at a rate of 4° C. per second (7.2° F. per second), straightening the aluminum alloy with a coining process, and artificial aging of the aluminum alloy between 60 and 140 minutes at 419° F. (215° C.). The reduced costs are achieved in part by using an aluminum alloy which is less costly than the comparative alloys Aural 2 and C65K.

The aluminum alloy used to form the reduced cost tempered aluminum alloy casting typically includes silicon in an amount of 4.0 to 9.0 weight percent (wt. %), copper in an amount up to 0.10 wt. %, iron in an amount up to 0.25 wt. %, manganese in an amount of 0.3 to 0.60 wt. %, magnesium in an amount of 0.10 to 0.60 wt. %, titanium in an amount up to 0.15 wt. %, strontium in an amount of 0.01 to 0.60 wt. %, and a balance of aluminum, except for possible incidental elements and/or impurities, based on the total weight of the aluminum alloy. According to example embodiments, the aluminum alloy casting comprises one of the alloys having compositions within the ranges disclosed in Table 1, which are referred to as C611 and Aural 5S. The balance of both alloys includes aluminum, except for possible incidental elements and/or impurities. These two alloys resemble one another but have slightly different chemical compositions. Table 2 includes additional example ranges for the aluminum alloys. The ranges can be used in any combination. For example, a minimum amount of an element from Table 1 can be used with a maximum amount listed in Table 2, and/or a minimum amount of an element from Table 2 can be used with a maximum amount listed in Table 1. In addition, a minimum or maximum amount of an element of the C611 alloy composition of Table 1 or Table 2 can be used in combination with a minimum or maximum amount of the Aural 5S alloy composition of Table 1 or Table 2, and vice versa.

TABLE 1

Aural 5S & C611 Aluminum Alloys

| | C611 | | Aural 5S | |
|---|---|---|---|---|
| | Min (wt %) | Max (wt %) | Min (wt %) | Max (wt %) |
| Si | 4.0 | 7.0 | 6.0 | 8.0 |
| Cu | | 0.05 | | 0.03 |
| Fe | 0.05 | 0.15 | | 0.25 |
| Mn | 0.40 | 0.80 | 0.30 | 0.60 |
| Mg | 0.15 | 0.25 | 0.10 | 0.60 |
| Ti | | 0.10 | | 0.15 |
| Sr | 0.01 | 0.03 | 0.01 | 0.03 |

TABLE 2

Aural 5S & C611 Aluminum Alloys - Example Ranges

| | C611 | | Aural 5S | |
|---|---|---|---|---|
| | Min (wt %) | Max (wt %) | Min (wt %) | Max (wt %) |
| Si | 6.3 | 6.9 | 7.1 | 7.9 |
| Cu | | | 0.01 | |
| Fe | 0.07 | 0.12 | 0.16 | 0.20 |
| Mn | 0.50 | 0.60 | 0.47 | 0.55 |
| Mg | 0.20 | 0.23 | 0.14 | 0.23 |
| Ti | 0.05 | 0.08 | 0.05 | 0.08 |
| Sr | 0.015 | 0.025 | 0.015 | 0.025 |

The less costly method used to form the component from the thermally stable tempered and cast aluminum alloy typically includes melting the aluminum alloy, casting the aluminum alloy, and possibly trimming the aluminum alloy. After the casting step, the cast aluminum alloy has an elongation of at least 8%, or at least 9 to 10%, which is preferred for self-piercing rivet processes. Thus, the method typically includes piercing the cast aluminum alloy. The method can further include deburring, surface grinding, and/or machining the cast aluminum alloy. After the casting and possible additional steps described above, the cast aluminum alloy can be shipped or otherwise transferred from the casting facility to another facility or location, such as to an OEM. After shipping the cast aluminum alloy, the method preferably includes the artificial aging process. This process typically includes applying a coating to the cast aluminum alloy, which is in the as-cast (F temper) condition, by an electrodeposition coating process, and curing the coating on the cast aluminum alloy to form the finished tempered component. For example, the OEM's existing electrodeposition coating process and paint bake oven can be used. The additional costly production steps of the comparative method described above are not required. Thus, the component formed from the tempered aluminum alloy casting is typically less costly to manufacture and is thermally stable. The reduced costs required to make the component can be achieved in part by using the electrodeposition coating process and the paint bake oven that already exists in operation at the OEM or another entity's assembly plant.

It is noted that the as-cast temper condition of the cast aluminum alloy is also referred as F-temper and/or foundry temper (more generally as-cast and/or as-fabricated). It is also referred to as the properties of the aluminum alloy casting without any post processing heat treatment. The mechanical properties of the as-cast aluminum alloy made with one of the Aural series of alloys (such as Aural 2, C65k, Aural 5S, or C611) change slightly over time after casting, but also stabilize after a certain period. This is known as natural aging. The lowest cost castings available are F temper, which is no heat treatment.

The electrodeposition coating process, such as the OEM or customer's existing process, can include a cross between plating and painting. Typically, electrodeposition coating processes are used for corrosion mitigation. According to one embodiment, the cast aluminum alloy is immersed in a water-based solution containing a paint emulsion. The coating thickness is limited by the voltage applied to the water-based solution. Since the coating is essentially liquid paint, once it has coated the cast aluminum alloy, a curing cycle is typically required at particular curing times and temperatures. The curing step is preferably conducted in an oven, such as a paint bake oven already used in production. The conditions of the curing cycle, such as curing time and temperature, can be determined in part by the chemistry of the coating. Since the chemistry of the electrodeposition coating can be provided by a chemical cross-linking process, the full cure typically requires both time and temperature to obtain the optimum coating properties. Multiple curing cycles, including heating for periods of time followed by cooling for periods of time, are typically repeated several times. However, these cure cycles can vary, for example from OEM to OEM, and even in different lines within the same OEM. After the F temper casting has been coated with the electrodeposition coated by itself and received, the electrodeposition cure is referred to as a T84. After the casting has completed the entire assembly process, and gone through all of the remaining paint cure ovens, the final condition of the aluminum alloy casting is referred to as a T85. The mechanical properties of the finished T85 casting should be approximate to the properties of a T5 aluminum casting formed according to the conventional process, without having to use the conventional oven at the foundry.

Typically, the electrodeposition coating and curing steps include applying the coating, heating the coated cast aluminum alloy for a period of time, and then allowing the coated cast aluminum alloy to cool to room temperature for a period of time. These steps are typically repeated a plurality of times, for example four times. The steps can be conducted in an electrodeposition coating oven, a primer oven, and/or an enamel oven. In an example embodiment, the first two cycles can be conducted in an electrodeposition coating oven, the third cycle can be conducted in a primer oven, and the fourth cycle can be conducted in an enamel oven. Each heating step can include heating to temperatures ranging from 180° F. to 385° F. for 9 to 25 minutes.

According to an example embodiment, an epoxy-type electrodeposition coating is applied to the cast aluminum alloy and then cured at a curing temperature of 320° F. for 20 minutes or 315° F. for 15 minutes, depending on the chemistry of the coating. As with paints, the energy used to cure the electrodeposition coating will also typically depend, in part, on the size and geometry of the cast aluminum alloy.

Figure 2:
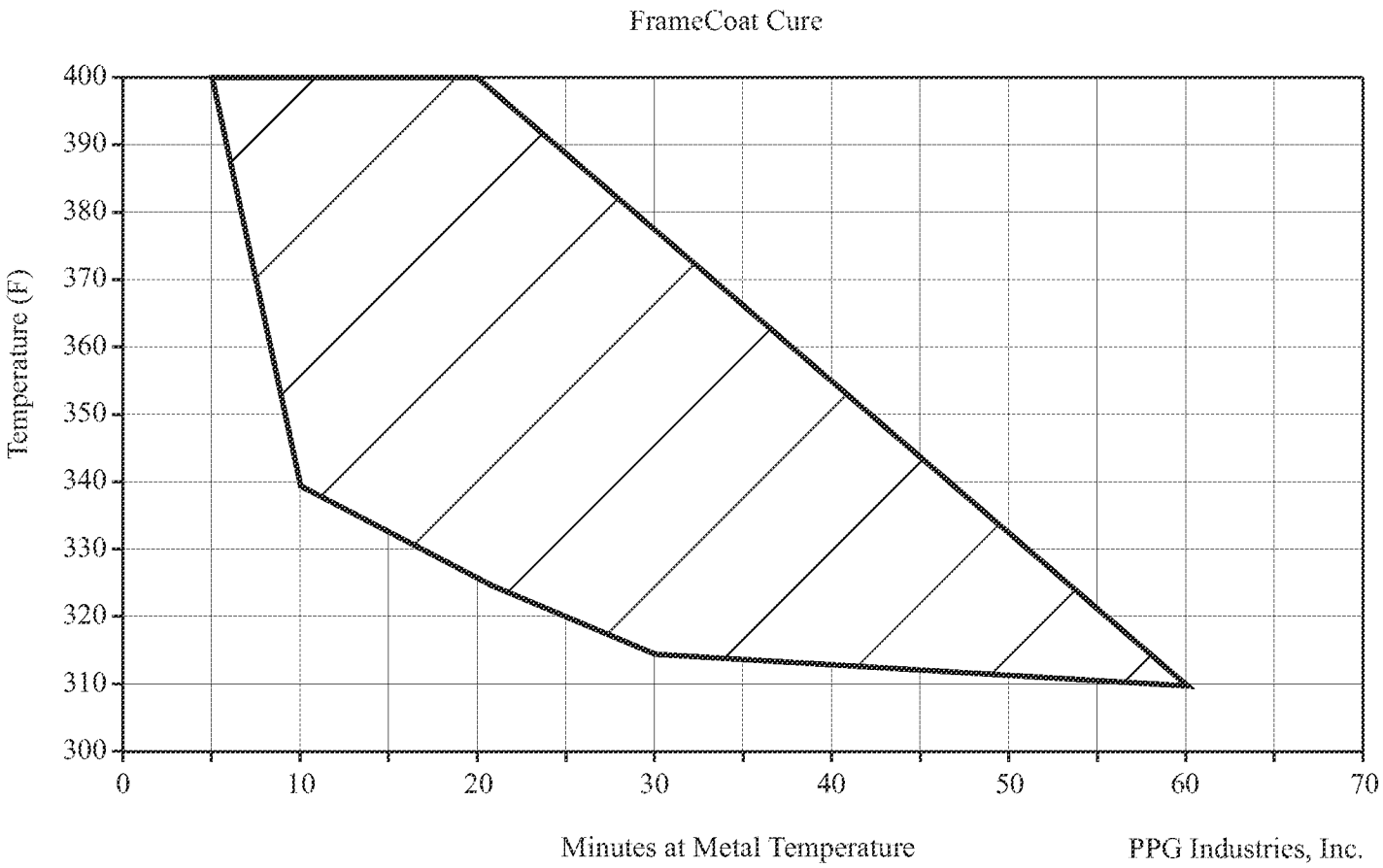
FIG. 2 is a graph of another curing window for another example electrodeposition coating process.

FIG. 1 is a graph of a curing window for an example electrodeposition coating referred to as CorMax® VI EP provided by DuPont™, wherein the optimum bake conditions for all properties are identified in a center window. The optimum bake conditions are surrounded by acceptable common bake conditions. In this case, optimum cure is a 360° F. (182° C.) for 20 minutes, which is in the middle of the window of the optimum bake conditions. A graph of a curing window for another example electrodeposition coating referred to as PPG FrameCoat® is provided in FIG. 2. For satisfactory cure, all coated areas of the production unit must be heated within the time and temperature window. The chart of FIG. 2 represents general guidelines for electrocoat cure, but should not substitute a manufacturer's paint engineering department specifications. For example, PPG ecoat supplier recommends that the nominal cure conditions of 20 minutes at 325° F. metal temperature should be used as minimums for oven design purposes.

As discussed above, the component formed of the tempered, cast aluminum alloy is thermally stable and can achieve mechanical properties suitable for automotive vehicle applications. The cast aluminum alloy typically has a yield strength (YS) ranging from 90 to 200 MPa, an ultimately tensile strength (UTS) ranging from 220 to 300 Mpa, and an elongation percentage (%) of 7.0% to 19% prior to any heat treatment of the cast aluminum alloy when tested according to the ASTM E8 specification. The cast aluminum alloy typically has a yield strength (YS) ranging from 100 to 220 MPa, an ultimately tensile strength (UTS) ranging from 230 to 320, and an elongation percentage (%) of 6.0% to 15% after coating the cast aluminum alloy and after curing the coating on the cast aluminum alloy.

Table 3 illustrates the yield strength, ultimate tensile strength, and elongation percent of the example C611 tempered cast aluminum alloy when tested in the form of 2.8 mm plates. The yield strength, ultimate tensile strength, and the elongation percent can all be tested according to the ASTM E8 tensile testing specification.

TABLE 3

C611 F (As-Cast) Temper Tensile Properties
C611 F Temper 2.8 mm Test Plates

| | YS | UTS | % Elong |
|---|---|---|---|
| Max | 136.6 | 279 | 15.6 |
| Nominal | 128.8 | 272.1 | 11.6 |
| Min | 117.7 | 253.5 | 7.7 |

Table 4 illustrates the illustrates the yield strength, ultimate tensile strength, and elongation percent of the example C611 paint bake tempered cast aluminum alloy when tested in the form of 2.8 mm excised castings. The yield strength, ultimate tensile strength, and elongation percent can all be tested to the ASTM E8 specification.

TABLE 4

| C611 (T85 Paint Bake) Temper Tensile Properties C611 T85 Bake 2.8 mm Excised Castings | | | |
|---|---|---|---|
| | YS | UTS | % Elong |
| Max | 155 | 282 | 13.4 |
| Nominal | 151 | 278 | 10.5 |
| Min | 140 | 262 | 8.8 |

As indicated above, the component formed of the tempered aluminum alloy casting is in a thermally stable condition after the reduced cost method. The thermally stable condition typically means there is no change in mechanical properties of the tempered aluminum alloy casting after a period of time. European manufacturers of automotive components typically require no change in mechanical properties after short term exposure to heat (1 hour at 400° F. (205° C.)) and after a long term exposure (1000 hours at 300° F. (150° C.)).

As stated above, the cast aluminum alloy typically has at least 8% or at least 10% elongation, which is preferred for riveting, and can be used to form the thermally stable component with reduced costs, relative to the comparative component and method which includes the use of the Aural 2 or C65K aluminum alloy. The Aural 2 or C65K aluminum alloy is known to be more expensive than the Aural 5S or C611 aluminum alloy due to the higher amount of silicon. Table 4 provides the composition of the Aural 2 and C65K aluminum alloys. The balance of the composition of Table 5 includes aluminum and possible incidental elements and/or impurities.

TABLE 5

| Aural 2 & C65k Aluminum Alloy Chemical Composition | | |
|---|---|---|
| | Aural 2 (C65k) | |
| | Min (wt %) | Max (wt %) |
| Si | 9.5 | 11.5 |
| Cu | | |
| Fe | | 0.25 |
| Mn | 0.3 | 0.70 |
| Mg | 0.10 | 0.60 |
| Ti | | 0.10 |
| Sr | 0.01 | 0.03 |

Figure 3:
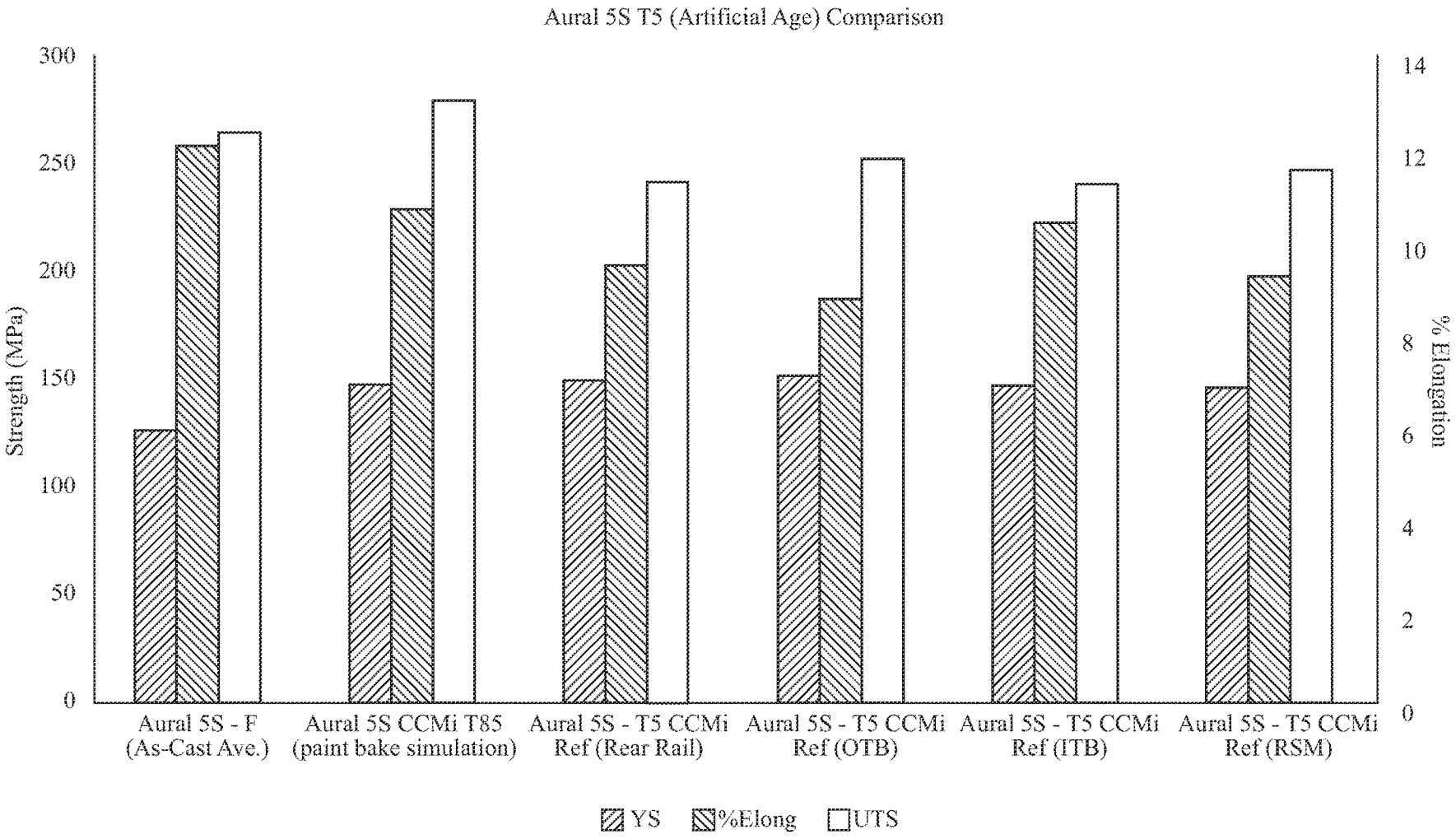
FIG. 3 is a graph illustrating the mechanical property results of a paint bake heat treatment simulation and an example T5 and T85 artificial age comparison for an example aluminum alloy referred to as Aural 5S.

Several experiments were conducted to evaluate the properties of the cast aluminum alloy and the tempered aluminum alloy casting formed by the reduce cost method according to various example embodiments. The methods tested included the use of electrodeposition processes and paint bake ovens already in use at OEM plants and an artificial aging process. The aluminum alloys tested were the Aural 5S and C611 aluminum alloys. The graph of FIG. 3 shows the results of a paint bake heat treatment simulation and an Aural 5S T5 and T85 artificial age comparison. More specifically, FIG. 3 is a graph illustrating the properties of the example cast Aural 5S aluminum alloy after being subjected to various different electrocoating deposition processes and paint bake ovens. The yield strength, elongation, and ultimate tensile strength were all measured using the ASTM E8 specification.

Figure 4:
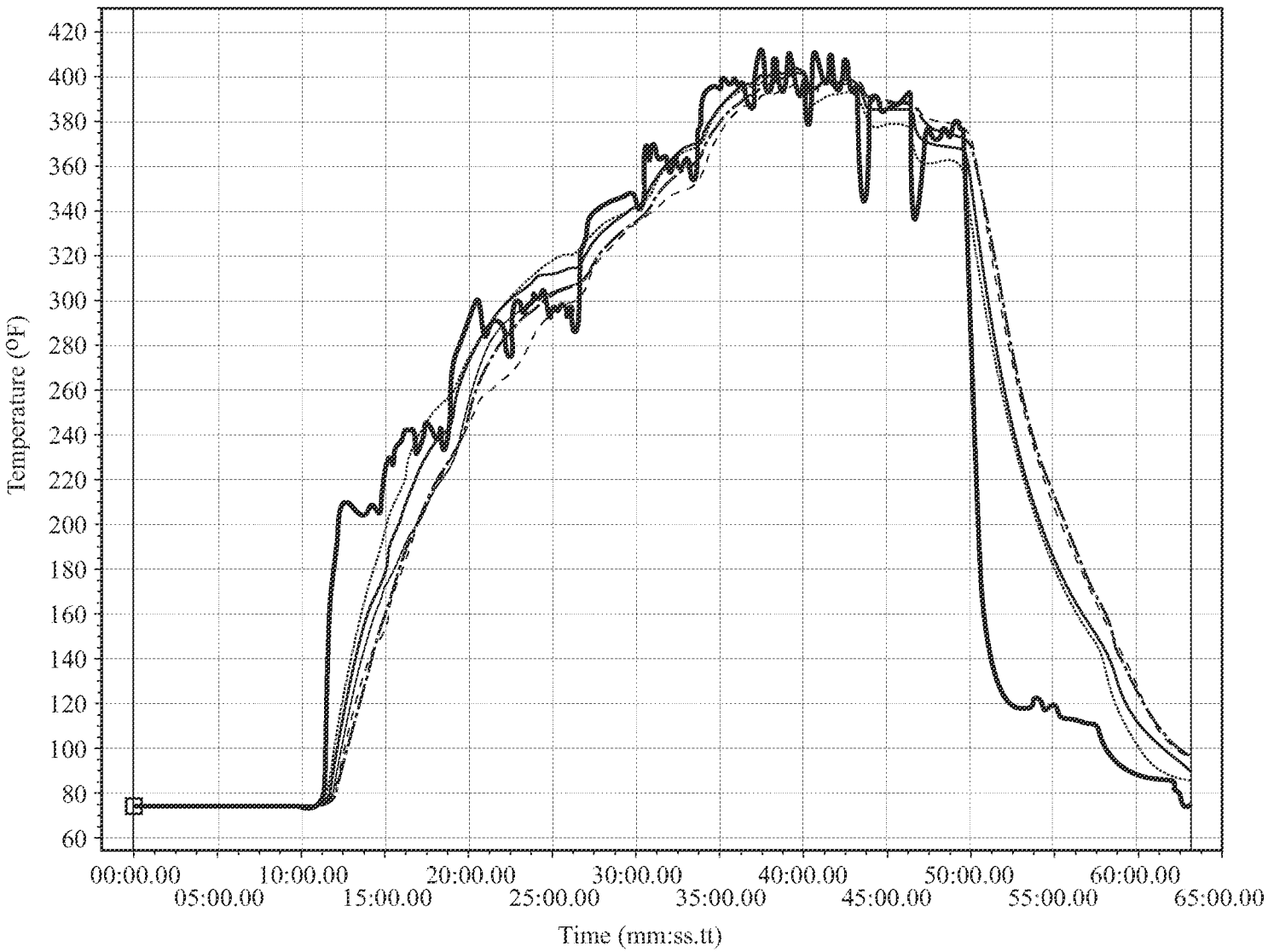
FIG. 4 illustrates a cure cycle for another example electrodeposition coating.
Figure 5:
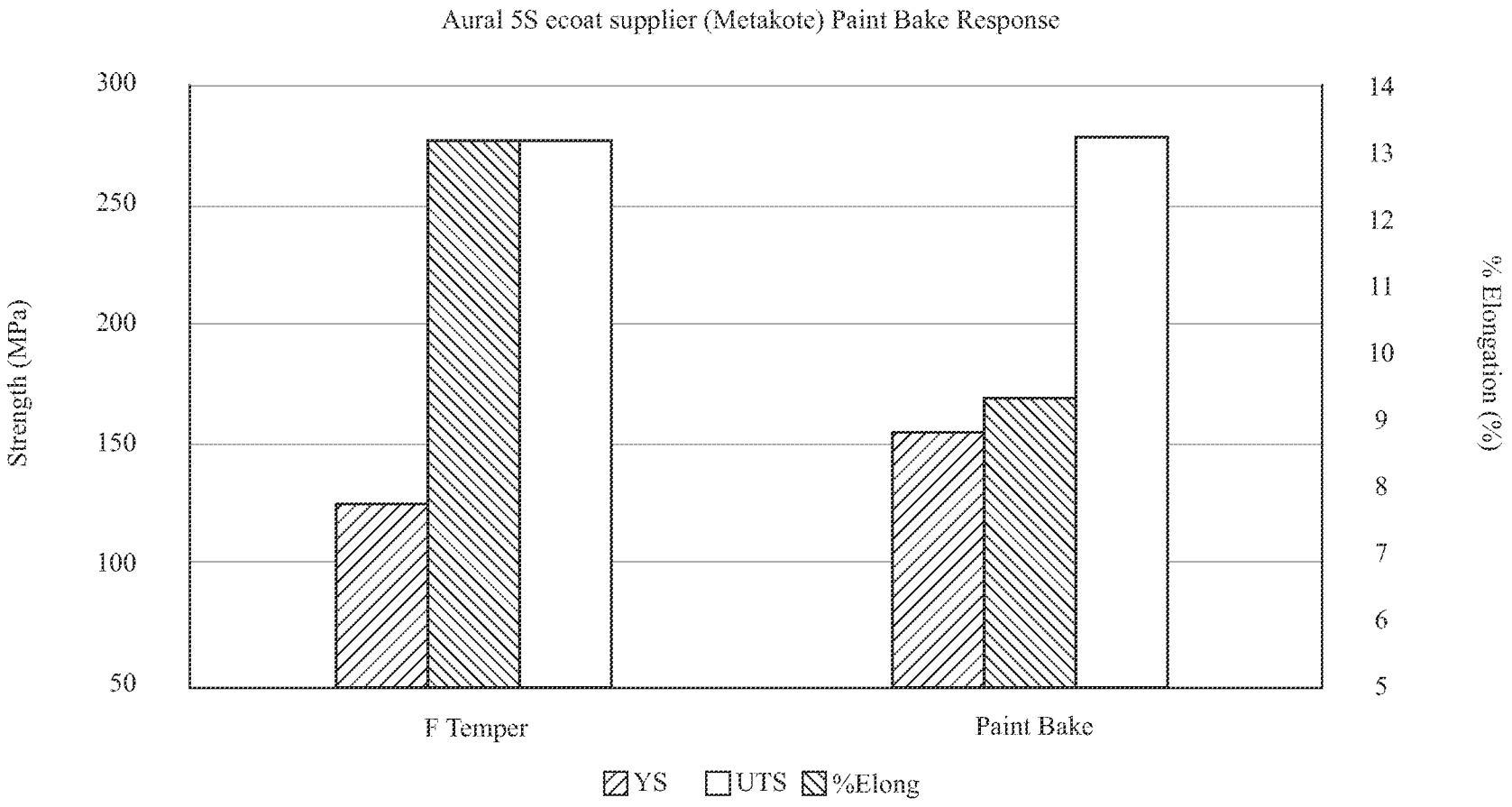
FIG. 5 illustrates the mechanical tensile properties before and after the example electrodeposition coating of FIG. 4 is applied to the Aural 5S aluminum alloy.

One method used to form the samples tested includes an electrodeposition coating provided by a supplier, MetoKote. The MetoKote paint cure cycle (time and temperatures) are shown in FIG. 4. The average cure time and temperature is approximately 370° F. (188° C.) for 14 minutes. The mechanical tensile properties before and after the Metakote paint bake cure cycle is applied to the Aural 5S alloy is shown in FIG. 5. The yield strength, elongation, and ultimate tensile strength were all measured using the ASTM E8 specification.

Figure 6:
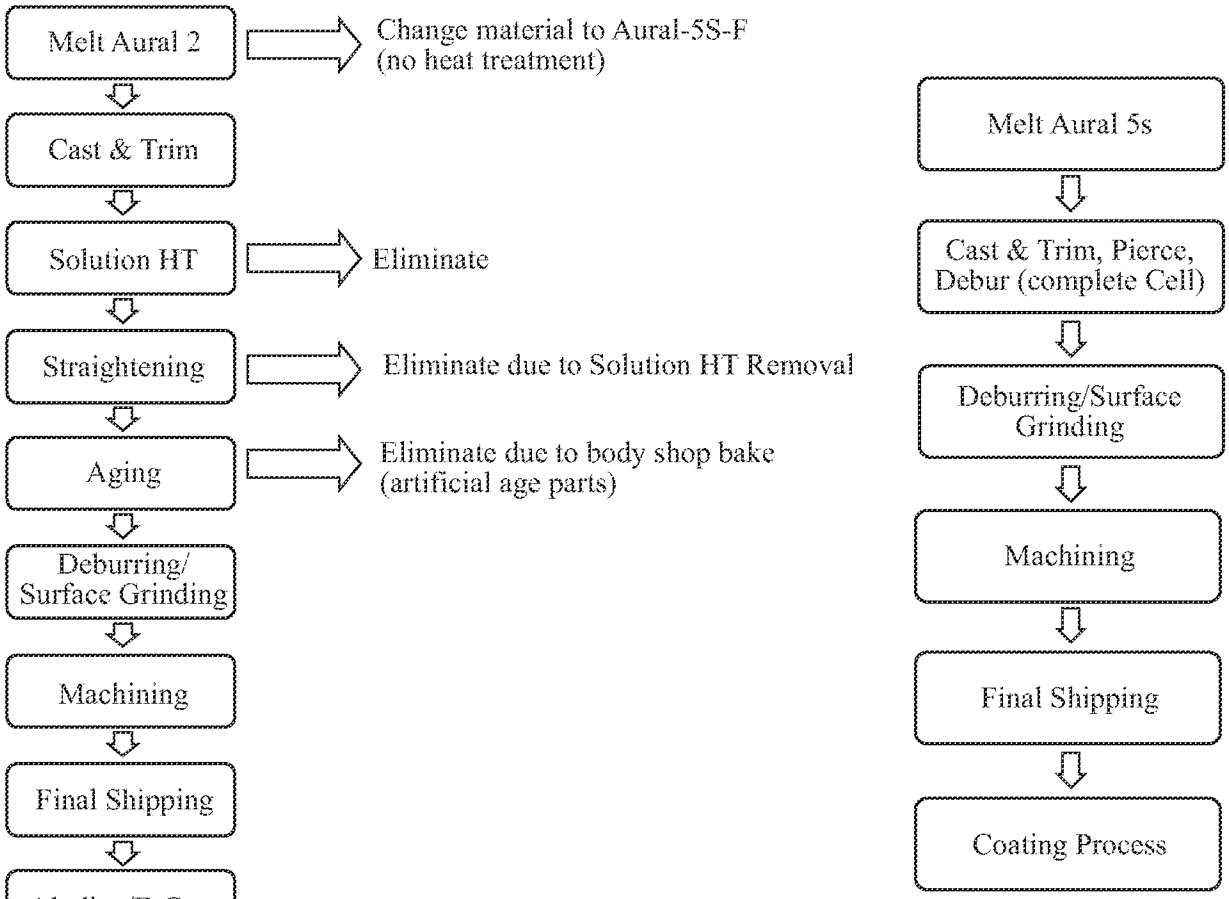
FIG. 6 includes flow diagrams of the reduced cost method of the present invention according to an example embodiment (right) and a comparative method/traditional approach (left)

FIG. 6 includes flow diagrams of an example of the reduced cost method of the present invention (right) and the comparative method (left). Both methods include forming a component from a tempered aluminum alloy casting. As shown in FIG. 6, the example method (right) includes only six steps, rather than ten steps, which contributes to the possible costs savings. The example method also includes a change of material from Aural 2 T7 to Aural 5SF. In addition, a heat treatment process is eliminated, which typically includes a solution heat treating step, forced air quench, and artificial aging heat treatment. A straightening operation is also eliminated. The use of the Aural 5S F temper allows these four processing steps to be eliminated. According to another embodiment, the method includes x-raying the alloy after the casting, piercing, and/or trimming step: the machining step is optional or can include cutting, such as robotic laser cutting; and the method can include applying a self-piercing rivet (SPR) to the component after the coating and curing or heat treating steps. The SPR process includes piercing the cast aluminum alloy or component without first forming a hole in the cast aluminum alloy. The components formed by the processes of FIG. 6 can be used as front shock towers, rear rails, etc.

As indicated above, the method can include a paint bake treatment already existing at the OEM's facility. This process includes applying a coating and/or paint to the aluminum alloy casting, heating the coating aluminum casting for a first period of time, and allowing the coated aluminum casting to cool for a second period of time. The coating, heating, and cooling steps can be repeated several times. The heat curves shown in FIGS. 4 and 8A-8C are examples of the times and temperatures of the heating steps conducted at the different OEMs. The multiple heating steps, conducted after coating and/or painting, together provide the aluminum casting with mechanical properties approximately equivalent to the mechanical properties of an aluminum casting after an artificial age T5 heat treatment at a foundry.

In this case, the aluminum alloy leaves the foundry in the as-cast (F temper) condition and has extra ductility, making the self-piercing riveting process easier. The aluminum alloy castings can then be subjected to an artificial aging (T5) treatment at the OEM paint line, versus at the casting facility. These steps are referred to as a T85 (paint bake) heat treatment. Due to the elimination of a heat treatment step, typical profile tolerances can be achieved without a secondary straightening process.

Figure 7:
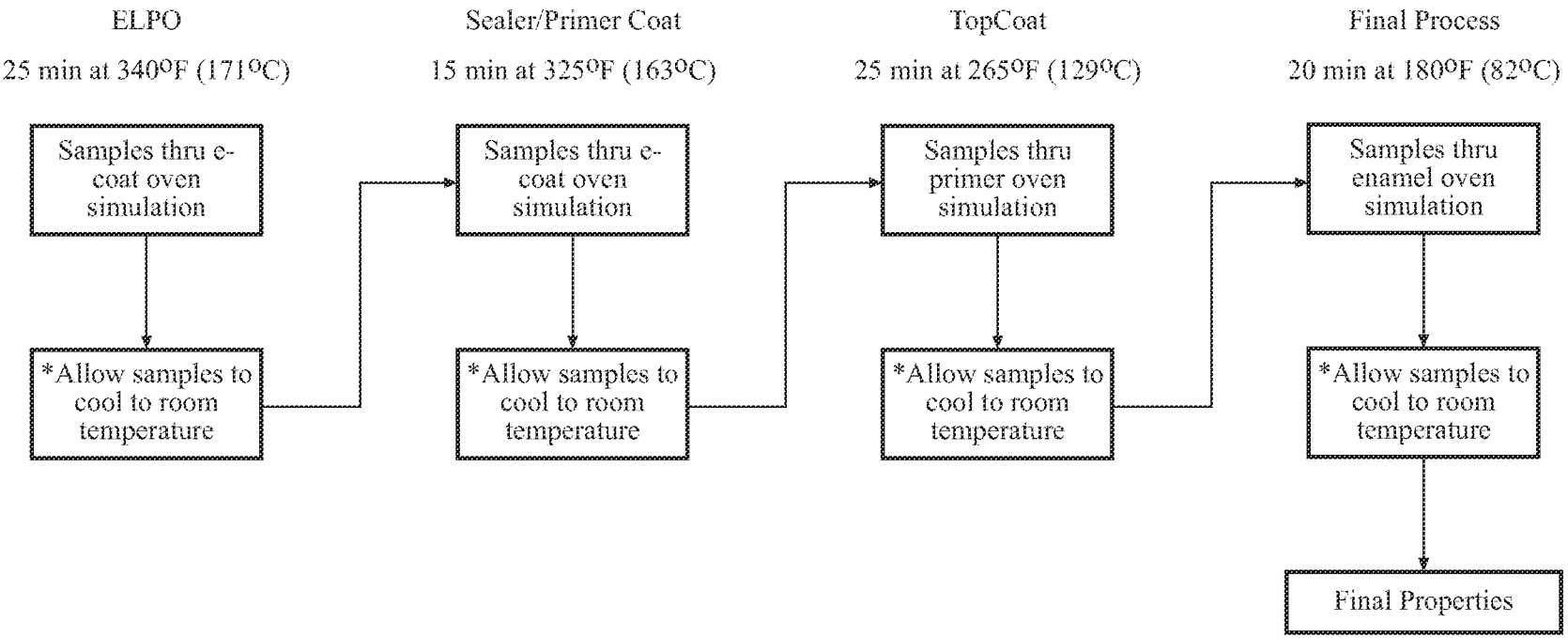
FIG. 7 is a process flow chart of an example paint bake study conducted at by a first manufacturer.

FIG. 7 is a flow chart of an example paint bake study conducted at Promatek research center of the first OEM cure cycles using the Aural 5S aluminum alloy. In the flow chart of FIG. 7, the term "ELPO" is an industry term for electrodeposition or ecoat. In FIG. 7, the total time at the listed temperatures is 85 minutes, and room temperature is assumed to be 24° C. for a minimum of 20 minutes.

Figure 8:
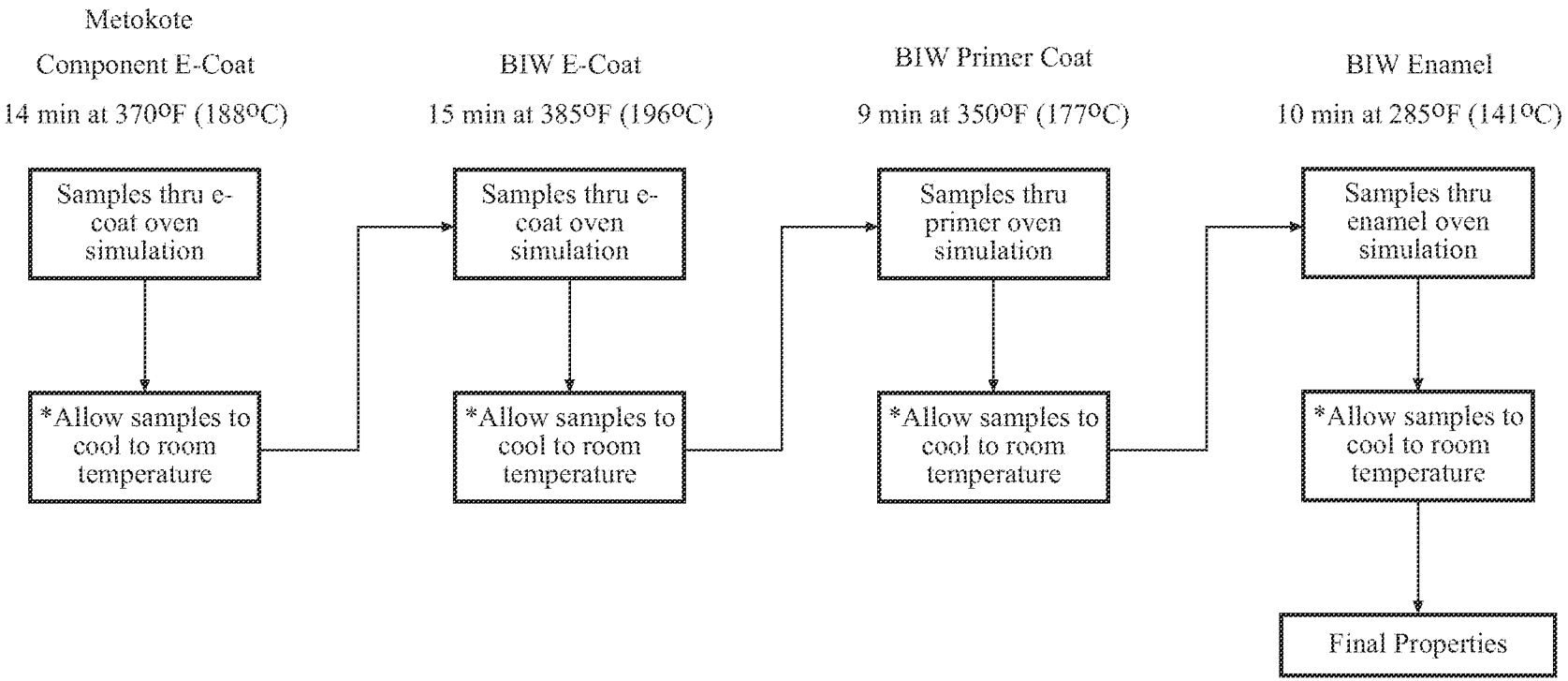
FIG. 8 is a process flow chart of an example paint bake study conducted at a second manufacturer.
Figure 8A:
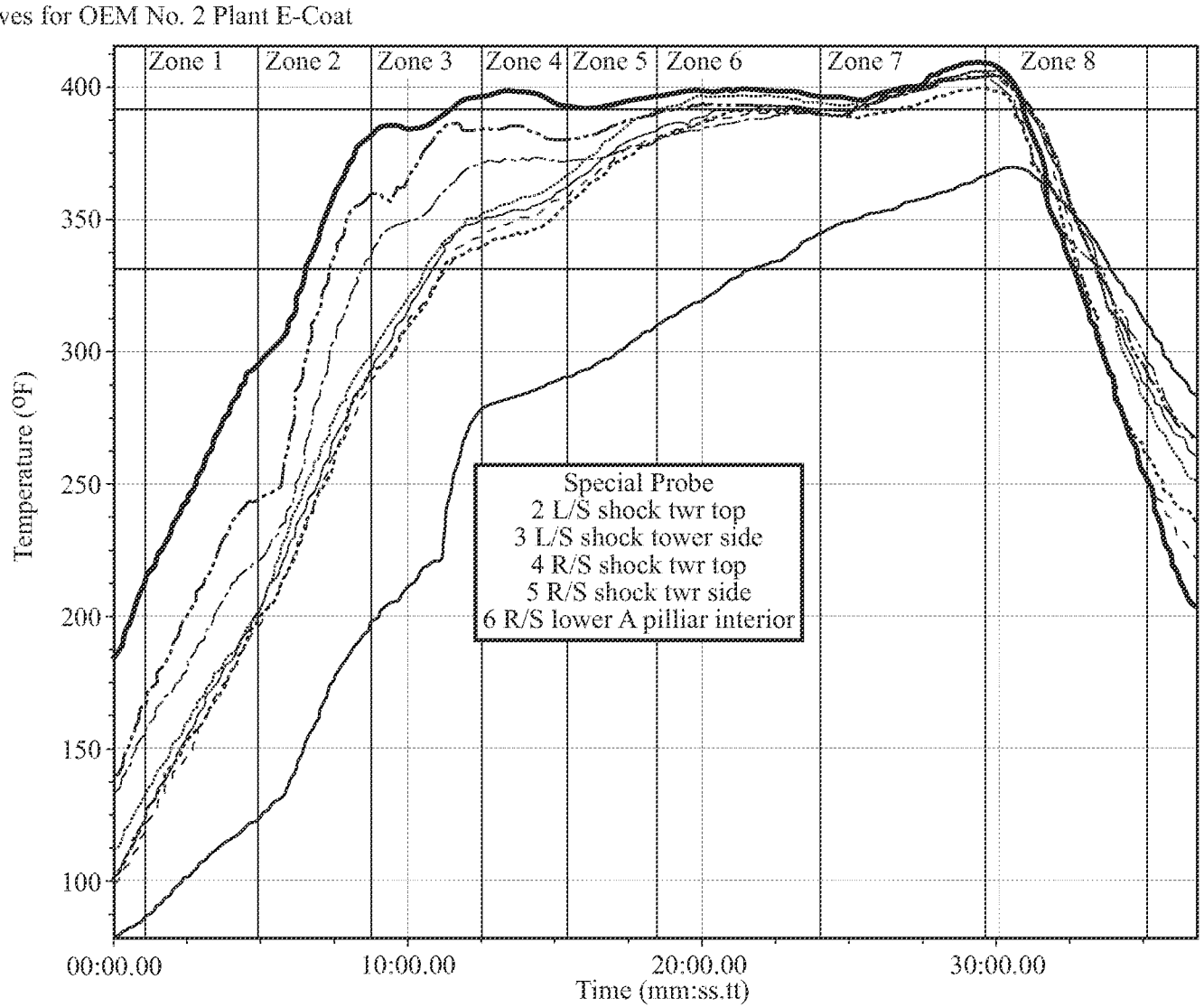
FIGS. 8A-8C are example heat curves used by the second manufacturer.
Figure 8B:
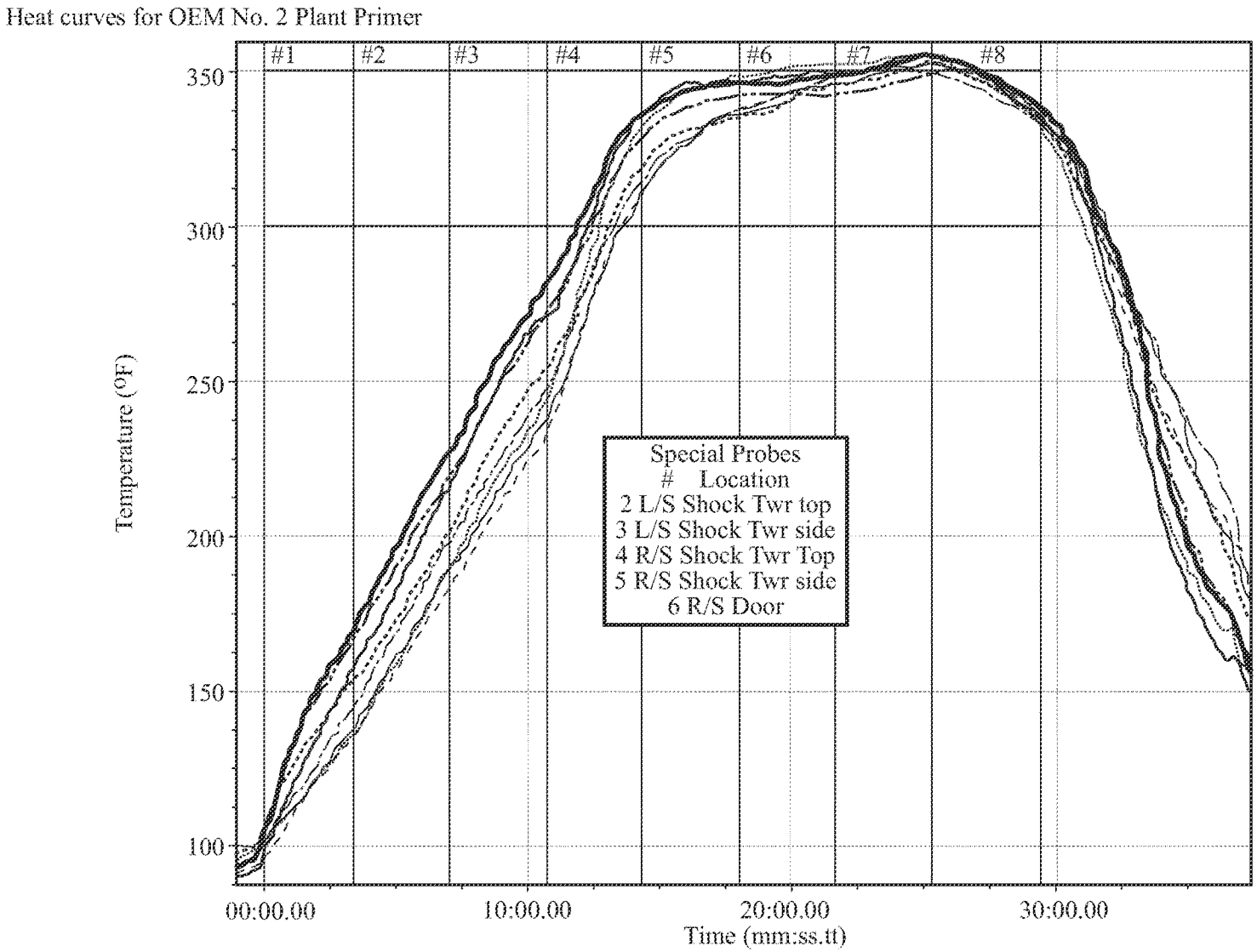
Figure 8C:
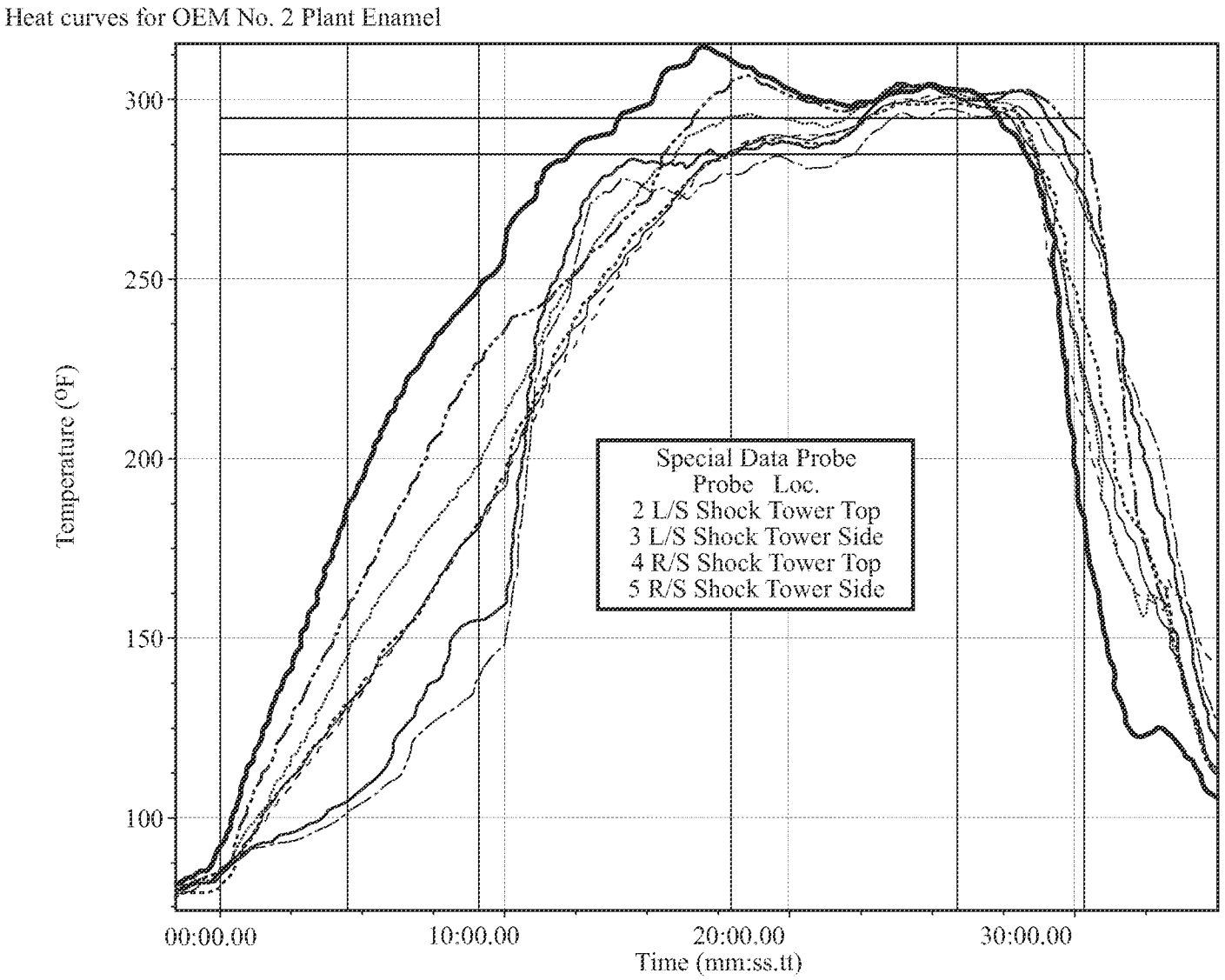

FIG. 8 is a flow chart of an example paint bake study conducted at Promatek research center of the second OEM cure cycles using the Aural 5S aluminum alloy. In the flow chart of FIG. 8, the term "MetoKote" is known as an electrodeposition coating supplier. The acronym "BIW" means "Body in White," referring to the vehicle body structure. FIGS. 8A-8C are example heat curves used by the fourth OEM. In FIG. 8, the total time at the listed temperatures is 48 minutes, and room temperature is assumed to be 24° C. for a minimum of 20 minutes.

Figure 9:
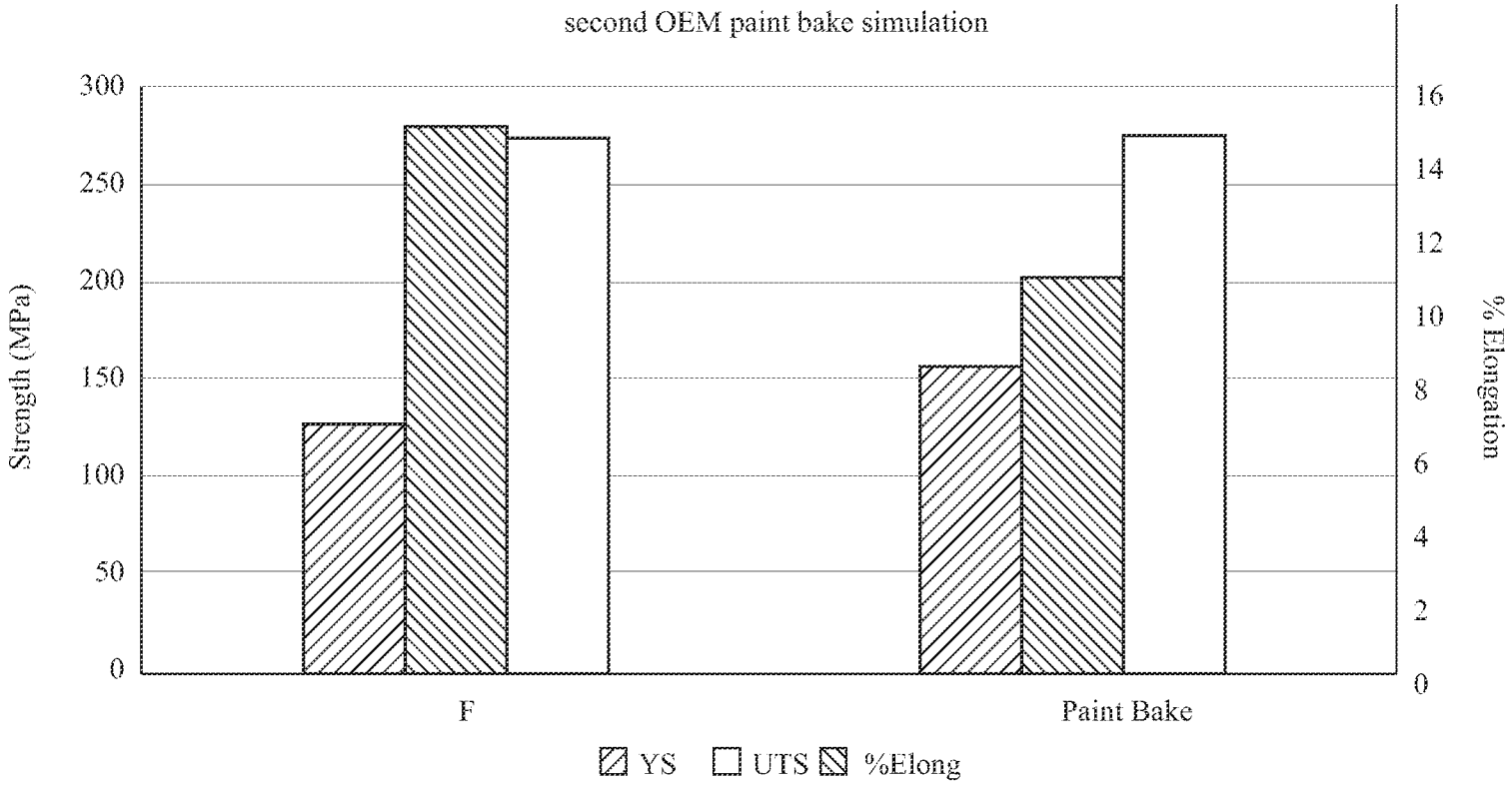
FIG. 9 is a graph illustrating the paint bake response of an example component formed using the process of the second manufacturer.

FIG. 9 is a graph illustrating the paint bake response of the component formed of the C611 tempered aluminum alloy casting using the process of the second OEM, including the yield strength, ultimate tensile strength, and % elongation of the component. The yield strength, elongation, and ultimate tensile strength were all measured using the ASTM E8 specification. The component tested was a 2.8 mm sample.

Figure 10:
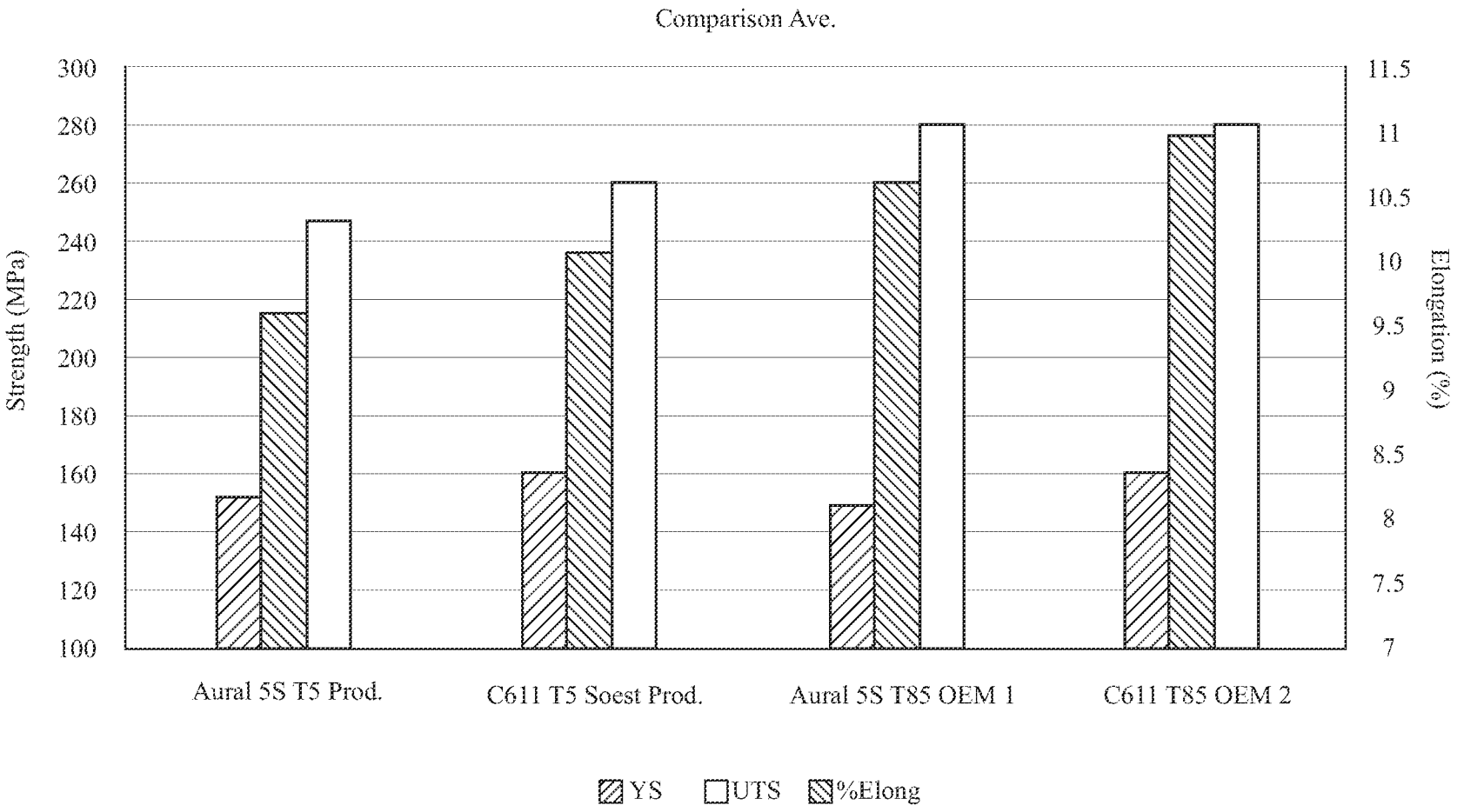
FIG. 10 is a graph illustrating a paint bake response of samples formed of the example tempered aluminum alloy castings using the processes of the first manufacturer, the second manufacturer, and two other processes.

FIG. 10 is a graph illustrating a paint bake response of samples formed of the tempered aluminum alloy casting, including the yield strength, ultimate tensile strength, and % elongation using the processes of OEM No. 1, OEM No. 2, and two other example processes. The label "Aural 5S-T5 Prod." refers to the use of the Aural 5S alloy with a traditional T5 (artificial age only) production component from the CAST House. The T5 (artificial age only) of this example is at 419° F. (215° C.) for 60 to 120 minutes. Typically, the CCMi Aural 5S T5 heat treatment cycle is 215° C. for 60 minutes. The label "C611 T5 Soest Prod." refers to the use of the Aural 5S alloy with a T5 (artificial age only) production component from Magna Germany CAST House located in Soest. The T5 (artificial age only) of this example is at 419° F. (215° C.) for 120 minutes. The artificial aging can be at temperatures from 150° C. to 250° C. and times from 30 minutes to 180 minutes.

In FIG. 10, the yield strength, the ultimate tensile strength, and the % elongation were all measured using the ASTM E8 specification. The "120/180/7" in FIG. 10 refers to minimum mechanical properties of 120 MPa (0.2% off set) yield strength, 180 MPa ultimate strength, and 7% (total % elongation). It is noted that different production casting section thickness results in different mechanical properties. The Aural 5S or C611 T5 minimum mechanical properties of this example embodiment are the 120/180/7.

Figure 11:
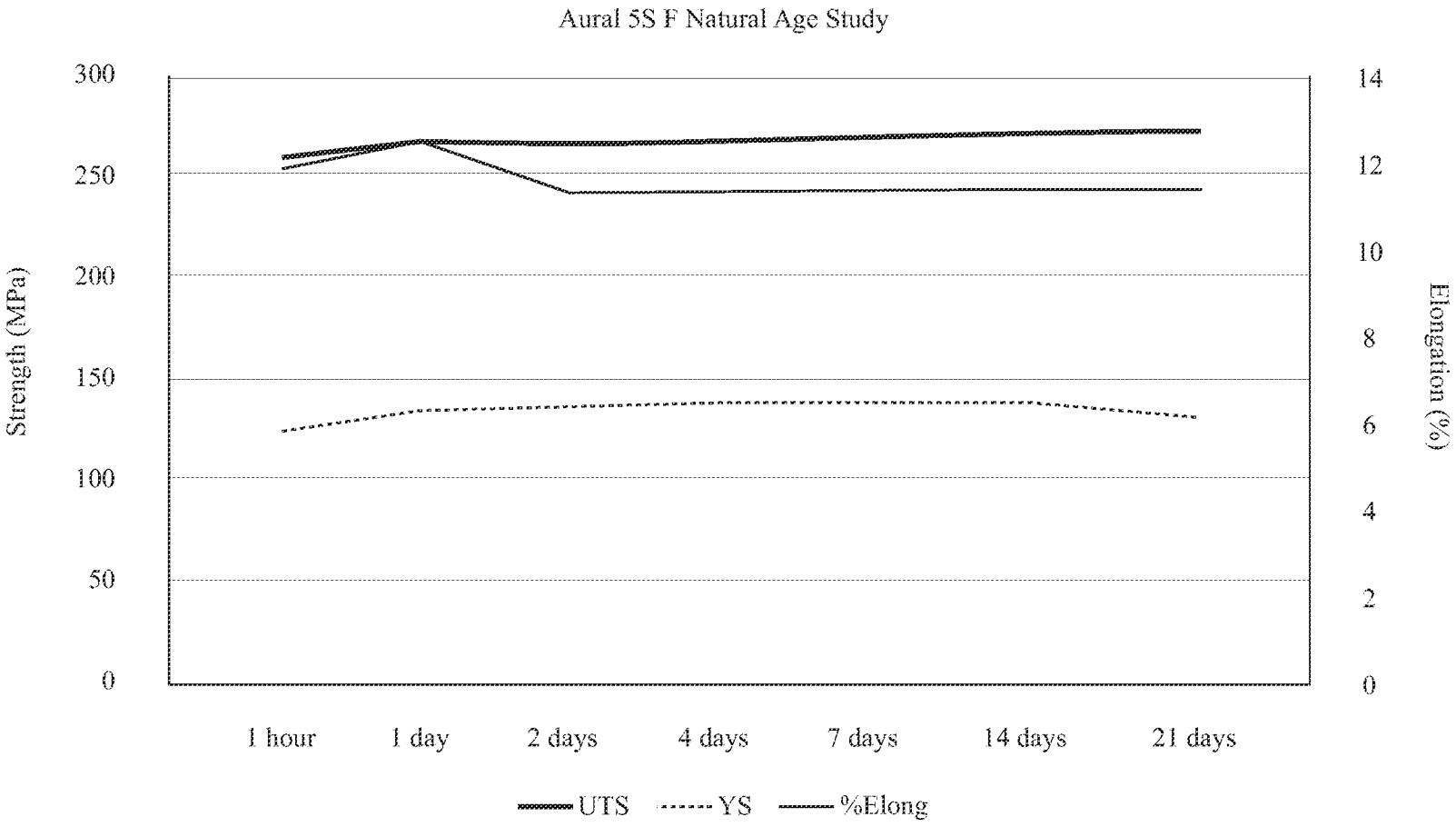
FIG. 11 is a graph illustrating mechanical properties when an example Aural 5S aluminum alloy casting is natural aged for 21 days.
Figure 12:
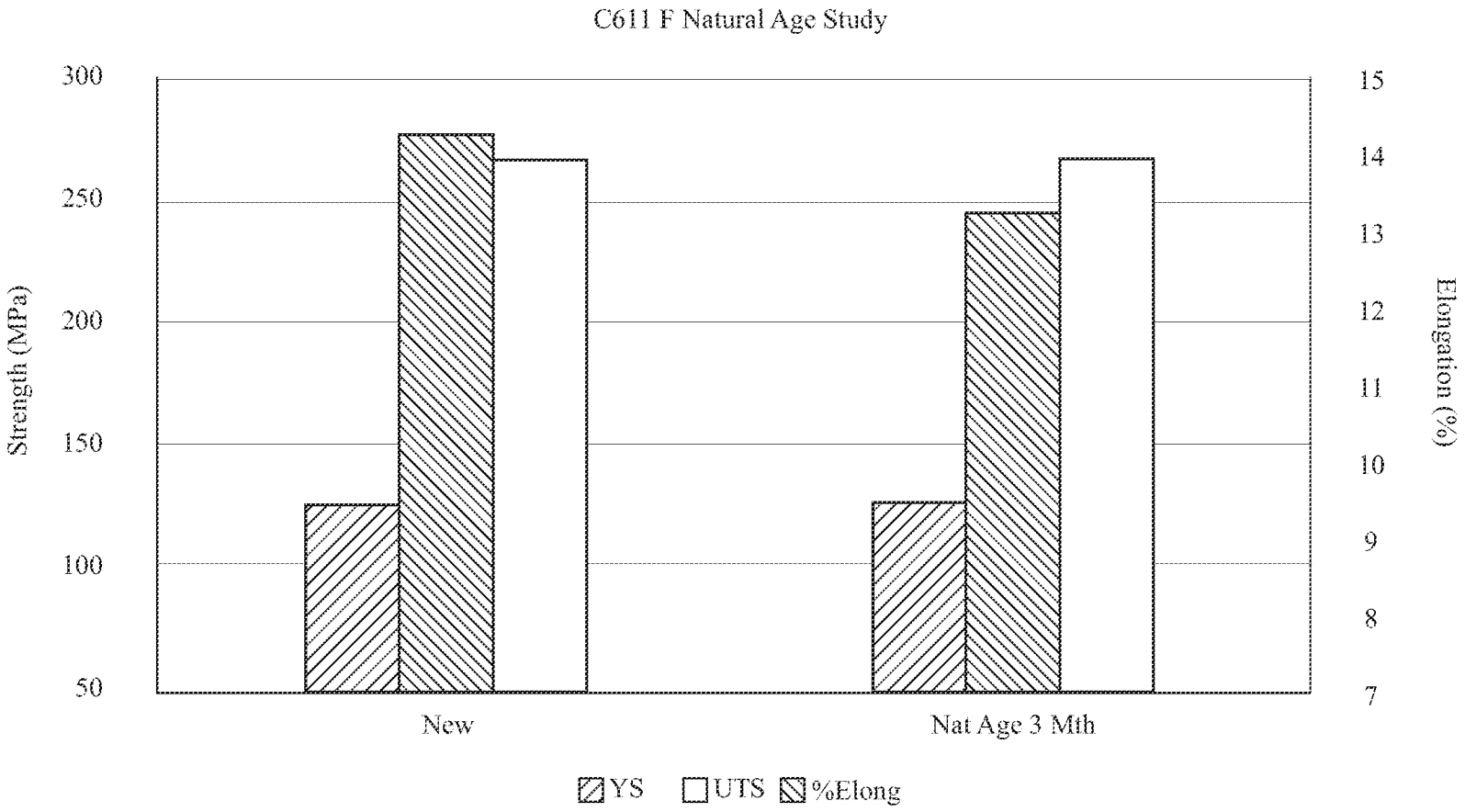
FIG. 12 is a graph illustrating mechanical properties when an example C611 aluminum alloy casting is natural aged for three months.

FIGS. 11 and 12 are graphs illustrating the results of natural age studies conducted on samples formed of the aluminum alloy casting according to example embodiments. Each graph illustrates the yield strength, the ultimate tensile strength, and the % elongation all measured using the ASTM E8 specification. FIG. 11 illustrates the results when the example Aural 5S aluminum alloy casting is natural aged for 21 days. It is noted that in the Aural series of cast aluminum alloys, the reorganization of the supersaturated alloying atoms can take place at room temperature, although this happens over a moderately long time period. The graph of FIG. 11 shows the mechanical properties have fully stabilized by a few days. The natural aging typically results in a slightly higher yield strength at the sacrifice of a slightly lower ductility. This may be beneficial because it allows for an initially softer material to join in the self-piercing rivet process and which then hardens in the downstream paint cure process without extra energy/process steps to the CAST House operations.

Figure 13:
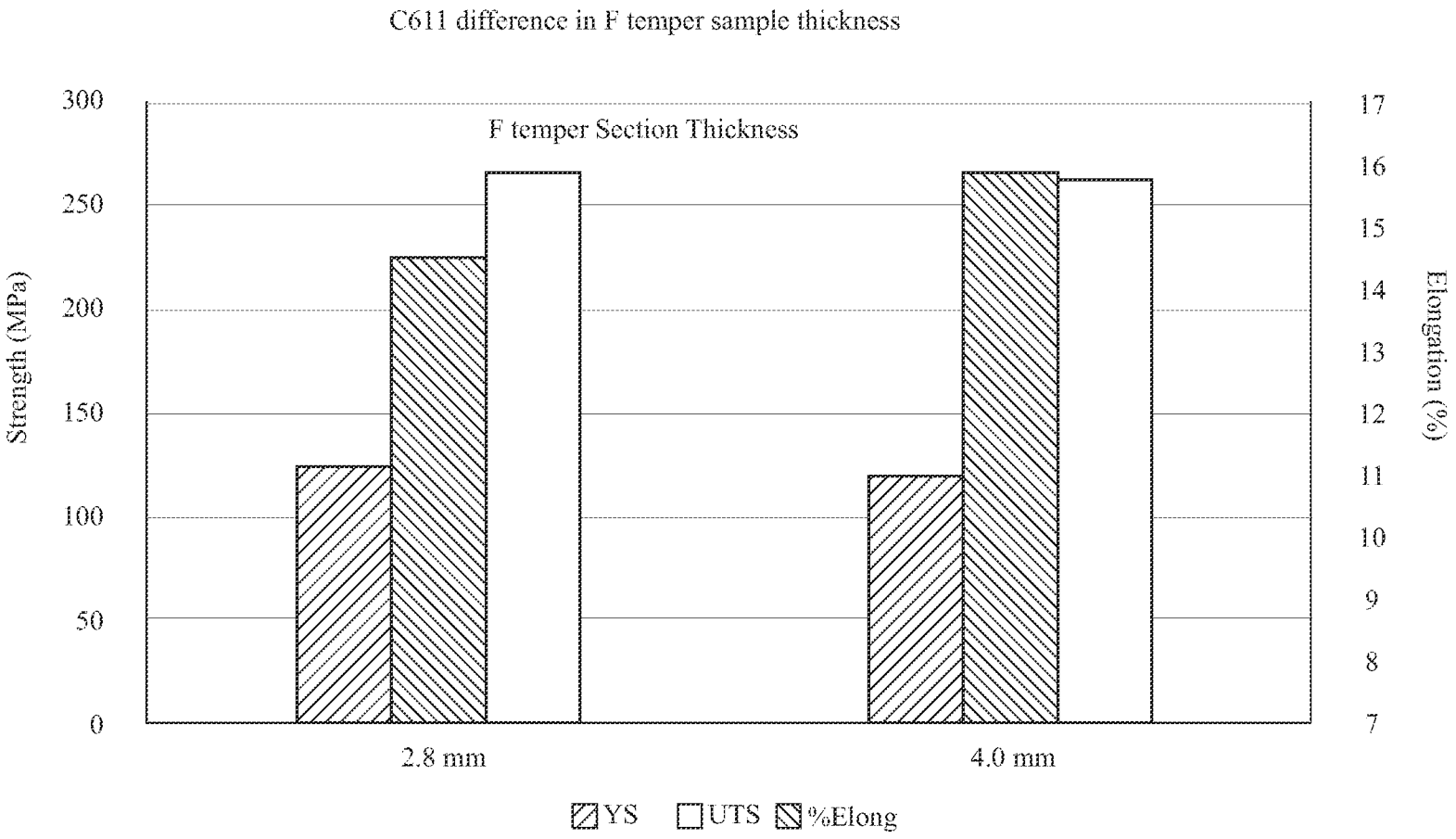
FIG. 13 is a graph illustrating how the difference in F temper sample thickness impacts the mechanical properties of aluminum alloy samples.

FIG. 12 illustrates the results when the example C611 aluminum alloy casting is natural aged for three months. The component tested was a 2.8 mm sample. FIG. 13 illustrates how the difference in the thickness and locations of the excised samples within the F temper casting formed of the example C611 aluminum alloy (2.8 mm and 4.0 mm samples) impacts the mechanical properties of the samples. For example, thicker samples may have mechanical properties different from thinner samples. Also, the samples take in locations closer to the gate may have better mechanical properties than samples taken from areas farther from the gate or near the areas of overflow, especially with regard to ductility and elongation. FIG. 13 also includes the yield strength, the ultimate tensile strength, and the % elongation all measured using the ASTM E8 specification.

Figure 14:
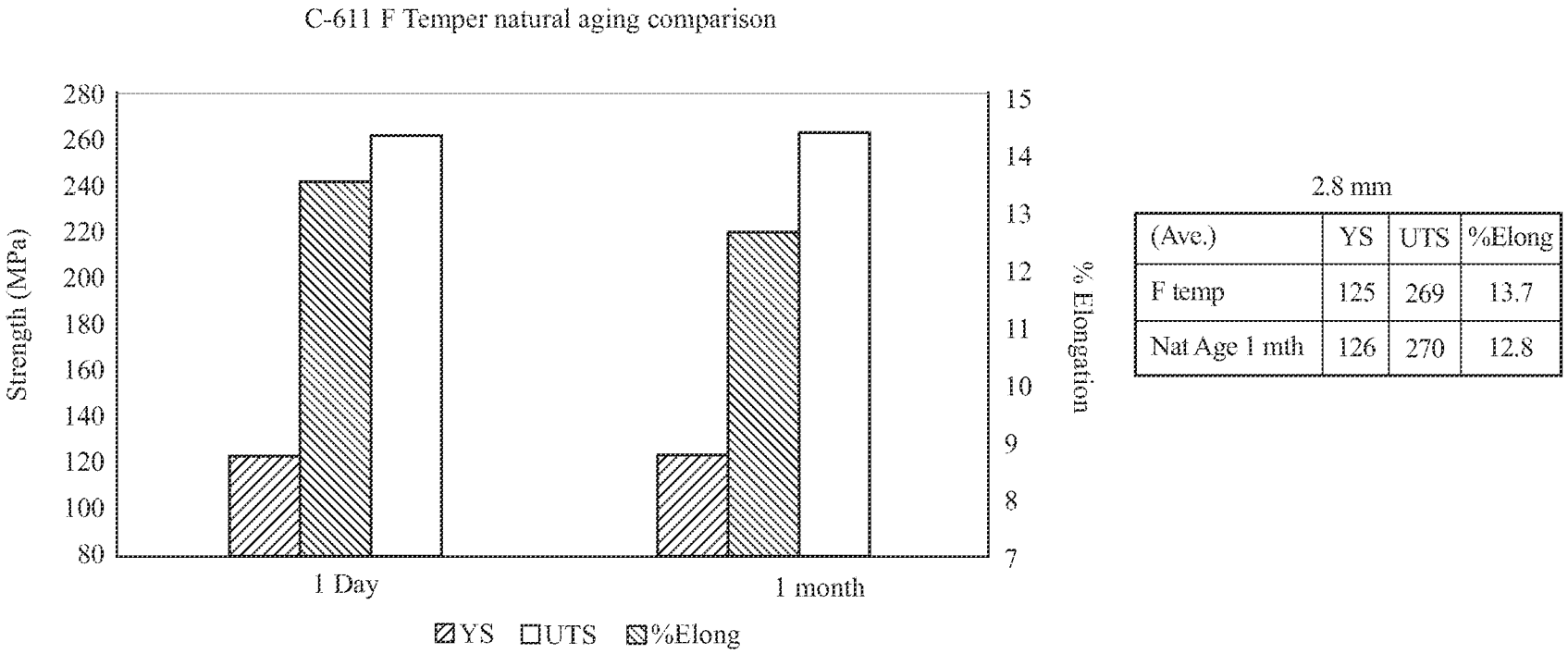
FIG. 14 is a graph comparing an example C611 F Temper sample to an example F+month natural age sample.
Figure 15:
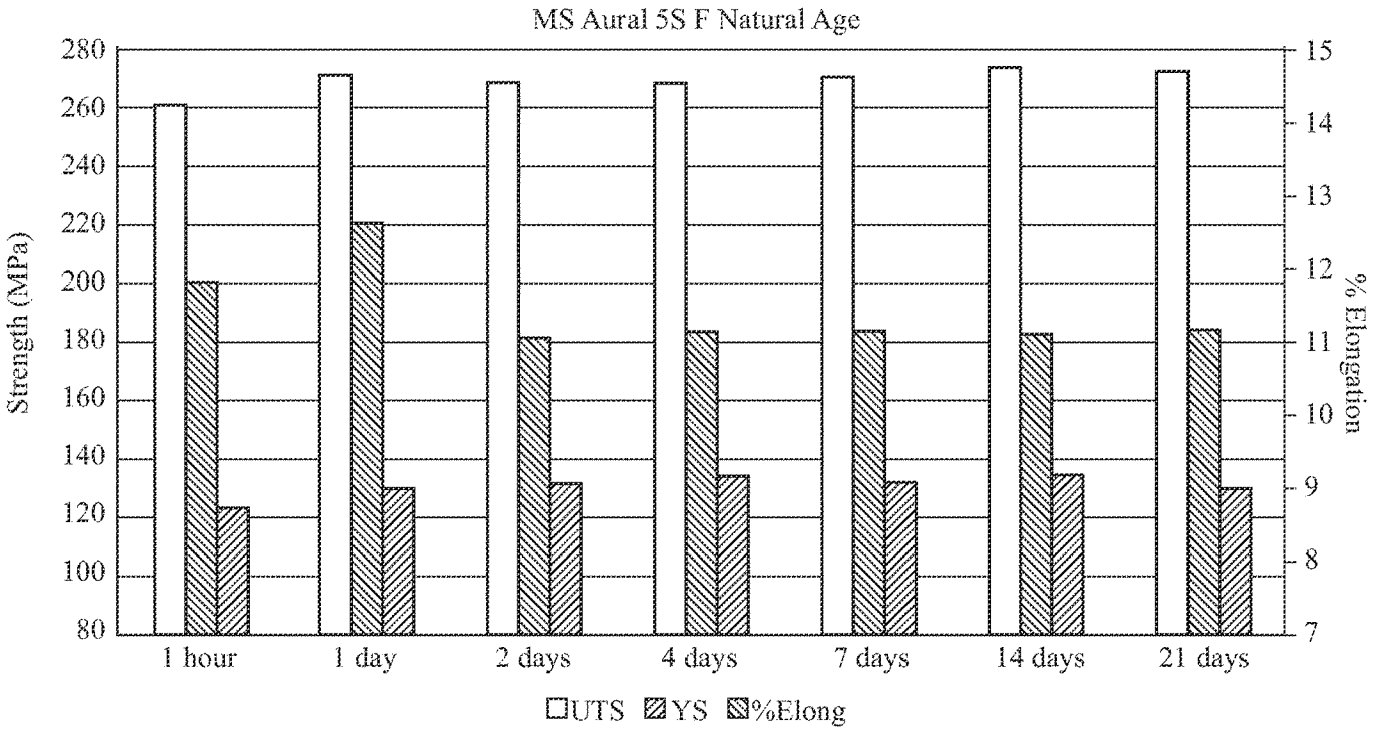
FIG. 15 is a graph illustrating the results of an example Aural 5S F temper natural age study.

FIGS. 14 and 15 include results of additional studies conducted on samples formed of the cast aluminum alloy according to example embodiments. The graph of FIG. 14 compares an example C611 F Temper sample to an example F+month natural age sample provided by the first OEM. More specifically, the graph compares a newly cast 2.8 mm C611 material and a 2.8 mm C611 casting that has naturally aged 1 month after casting. The sample material properties show that the naturally aging response is minimal. The samples tested were taken from a rear rail component for a vehicle application. The natural aging should also be noted. The graph of FIG. 15 illustrates the results of an example Aural 5S F temper natural age study. This study involved Aural 5S F temper test plate coupons from a supplier. Again, the study is similar to the C611 F temper+1 month natural age only using test coupons instead of samples excised from production castings. It is noted that FIGS. 11 and 15 include the same data shown in different ways.

Figure 16:
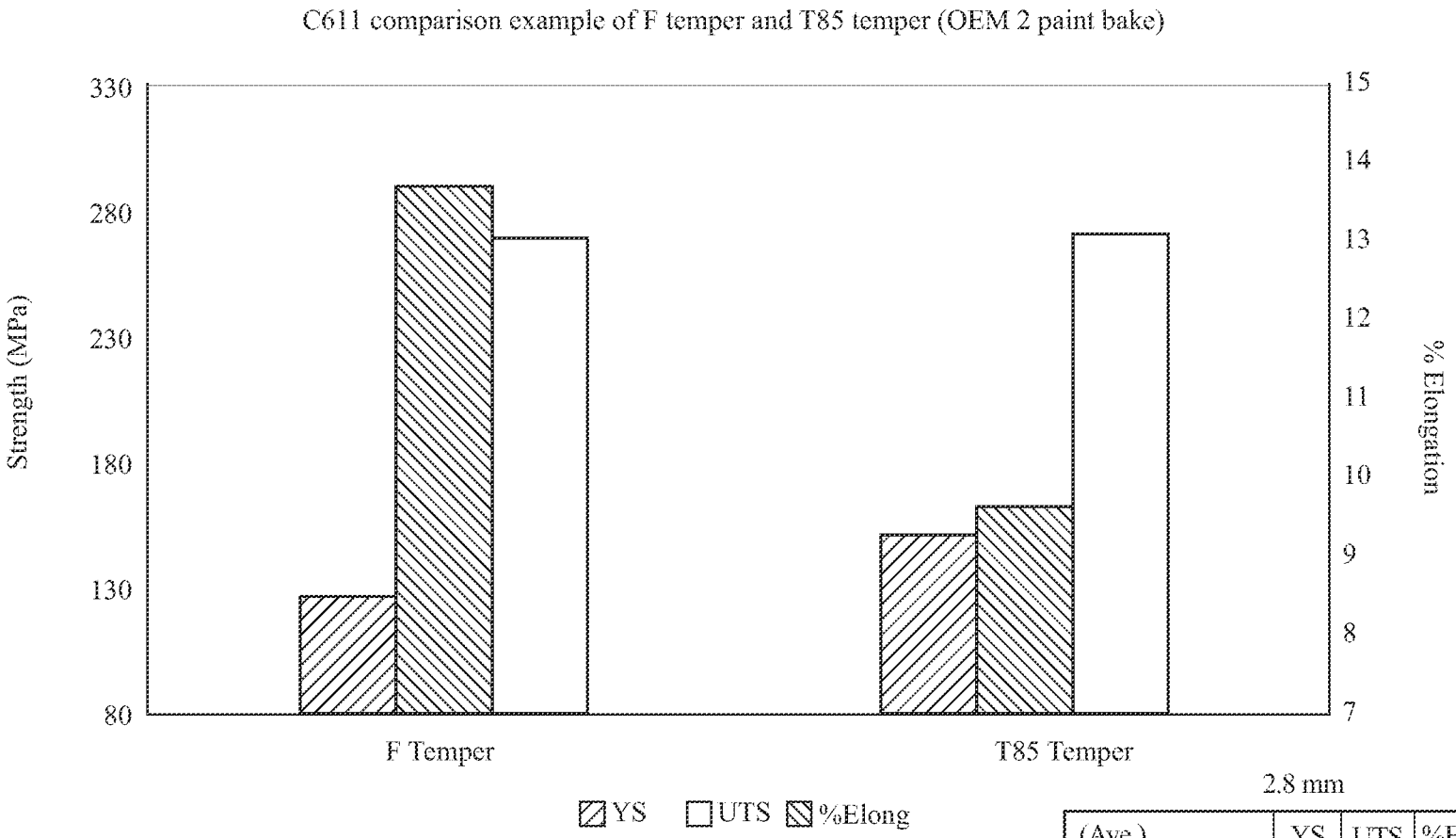
FIG. 16 illustrates the results of a study of an example C611 F temper sample versus an example T85 temper (paint bake) sample.

FIG. 16 illustrates the results of a study of an example C611 F temper sample verses an example T85 (paint bake) sample provided by the first OEM. The graph of FIG. 16 shows the progression of the example C611 aluminum alloy from the F temper (as-cast) state to the paint bake cure oven. The paint bake cure cycle can act as a substitute for the artificial age heat treatment stage (T5).

Figure 17:
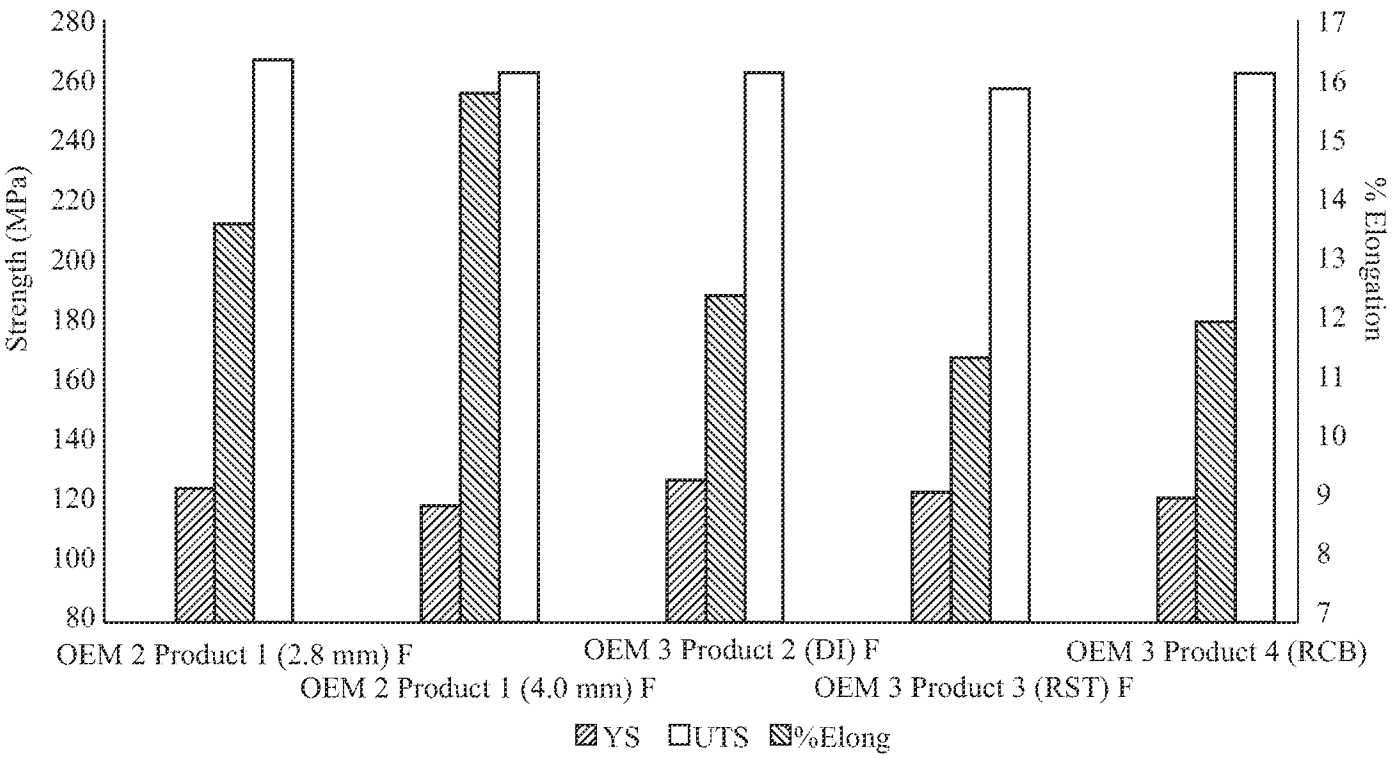
FIG. 17 is a comparison of example C611 F temper samples provided by a first manufacturer compared to example F temper samples provided by a second manufacturer.
Figure 18:
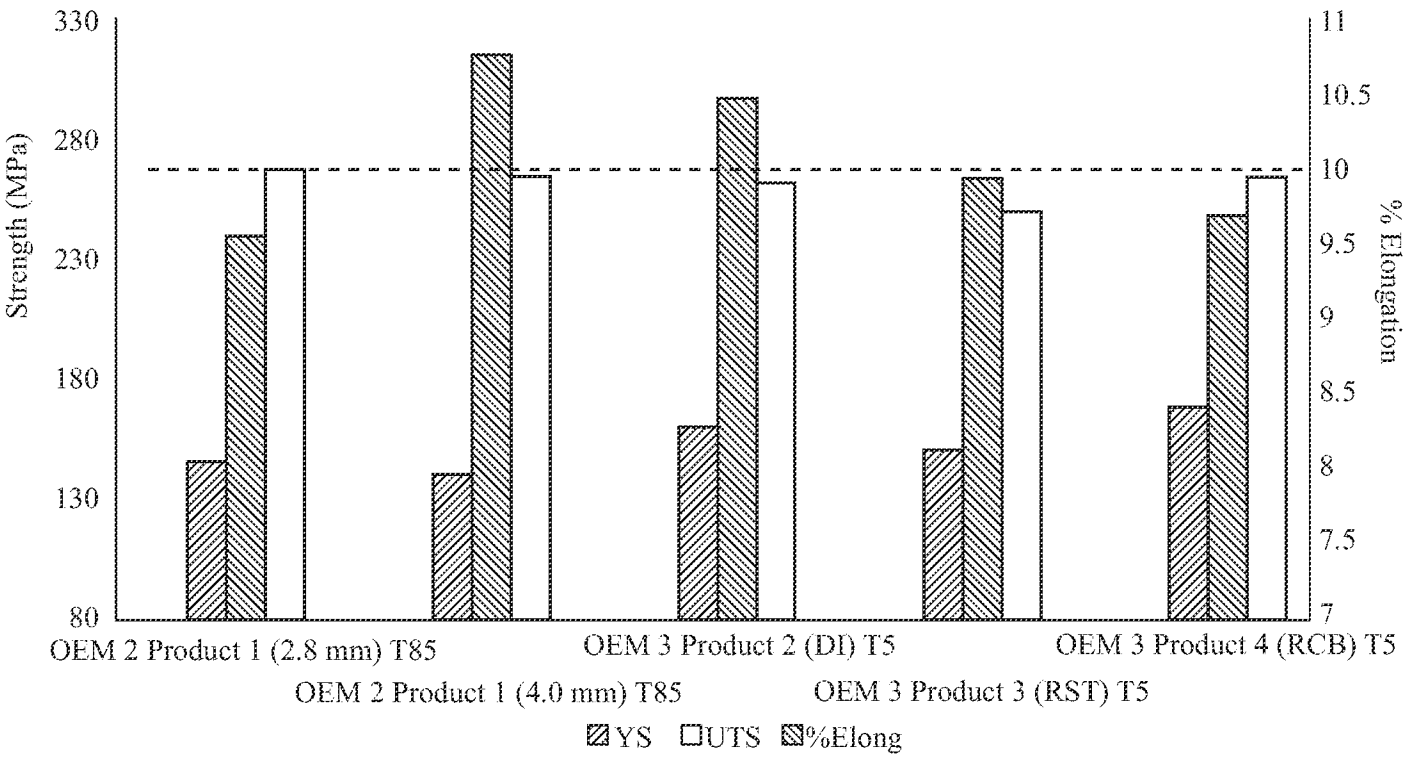
FIG. 18 is a comparison of example C611 paint bake samples provided by a first manufacturer and example T5 samples provided by another manufacturer.

FIG. 17 is a comparison of example C611 F temper samples provided by a second OEM compared to example F temper samples provided by a third OEM. FIG. 18 is a comparison of example C611 paint bake samples provided by a second OEM and example T5 samples provided by a third OEM. More specifically, the graph and chart of FIG. 18 is a comparison of example C611 paint bake samples provided by the second OEM and example T5 samples production samples for a third OEM. FIG. 18 shows the example C611 aluminum alloy properties from the T85 (paint bake) cure oven of the second OEM's component is approximately equivalent to the artificial age heat treatment stage (T5) for the actual C611 production parts from the third OEM. The results show that all averages are above the 9.6% elongation.

Figure 19:
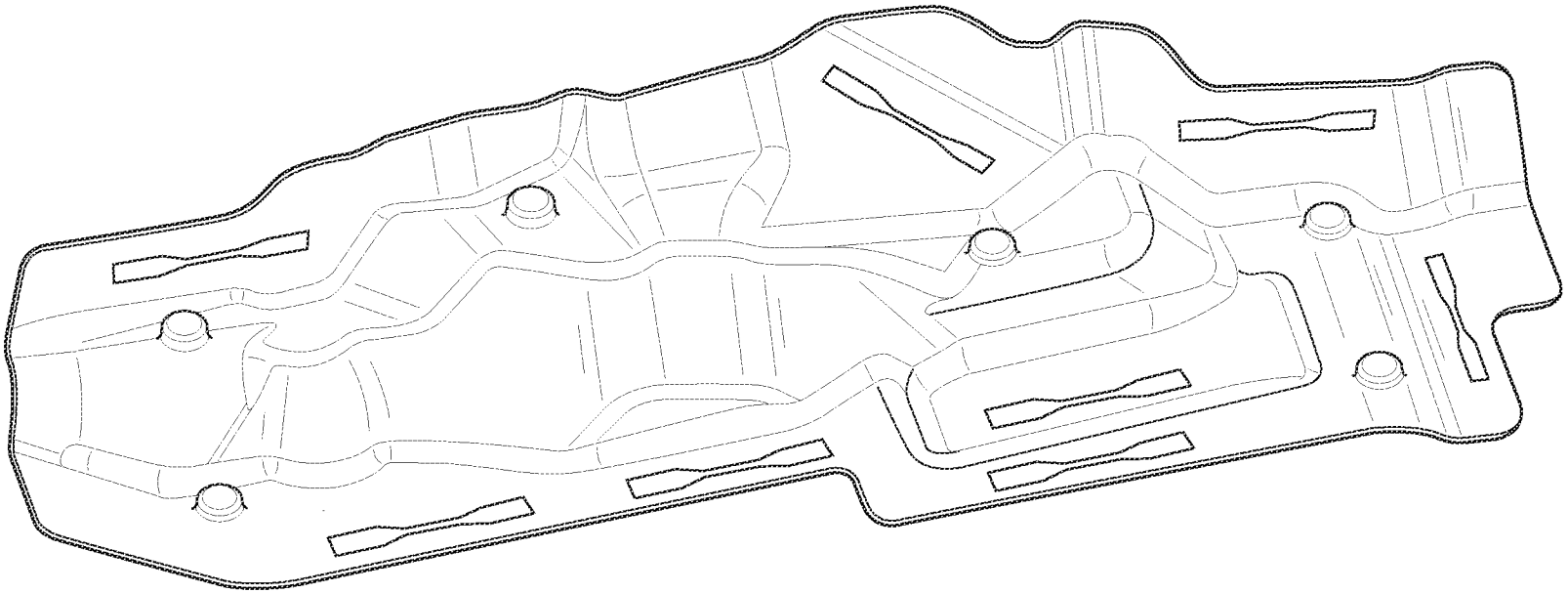
FIG. 19 is an example of the component formed of the tempered aluminum alloy casting made using the reduced cost method and mechanical property tensile bar locations.

FIG. 19 is an example of the component formed of the tempered aluminum alloy casting made using the reduced cost method and the locations of the various tensile bars that where excised from the casting in order to determine the mechanical properties. FIG. 19 shows that all the sample are above 9.6% elongation.

Obviously, many modifications and variations of the present invention are possible in light of the above teachings and may be practiced otherwise than as specifically described while within the scope of the claims.

What is claimed is:

1. A method of manufacturing a cast aluminum alloy, comprising the steps of:

casting an aluminum alloy, the aluminum alloy including silicon in an amount of 4.0 to 9.0 weight percent (wt. %), copper in an amount up to 0.10 wt. %, iron in an amount up to 0.25 wt. %, manganese in an amount of 0.3 to 0.60 wt. %, magnesium in an amount of 0.10 to 0.60 wt. %, titanium in an amount up to 0.15 wt. %, strontium in an amount of 0.01 to 0.6 wt. %, and a balance of aluminum, except for possible incidental elements and/or impurities, based on the total weight of the aluminum alloy;

applying a coating to the cast aluminum alloy;

heating the coated cast aluminum alloy;

wherein the cast aluminum alloy has an F temper designation before the heating step and the cast aluminum alloy has a T85 temper designation after the heating step, and wherein the cast aluminum alloy has a yield strength (YS) ranging from 90 to 200 MPa, an ultimate tensile strength (UTS) ranging from 220 to 300 MPa; and an elongation percentage (%) of 7.0% to 19% prior to the heating of the cast aluminum alloy when tested according to an ASTM E8 specification; and the cast aluminum alloy has a yield strength (YS) ranging from 100 to 220 MPa, an ultimate tensile strength (UTS) ranging from 230 to 320; and an elongation percentage (%) of 6.0% to 15% after the heating of the cast aluminum alloy, wherein the heating step includes curing the coating on the cast aluminum alloy.

2. A method according to claim 1 including transferring the aluminum alloy from a first location to a second location after casting the aluminum alloy, and wherein the heating of the cast aluminum alloy is conducted at the second location.

3. A method according to claim 2, wherein the second location where the heating step is conducted is an original equipment manufacturer (OEM) of a component for a vehicle.

4. A method according to claim 2, wherein the first location is a foundry.

5. A method according to claim 2, wherein the second location where the heating step is conducted is an original equipment manufacturer (OEM) of a component for a vehicle and the first location is a foundry;

the heating step is conducted in a paint bake oven, electrodeposition coating oven, a primer oven, and/or an enamel oven;

the aluminum alloy forms at least a portion of a component for an automotive vehicle;

the heating step is conducted at temperatures ranging from 180° F. to 385° F.;

the heating step includes at least one cycle, wherein each cycle ranges from 9 to 25 minutes;

piercing the cast aluminum alloy without forming a hole in the aluminum alloy prior to the piercing step; and the cast aluminum alloy has an elongation of at least 8% prior to the heating of the cast aluminum alloy.

6. A method according to claim 5, wherein the piercing step is conducted prior to the coating step and prior to the heating of the cast aluminum alloy.

7. A method according to claim 1, wherein the heating step is conducted in a paint bake oven, an electrodeposition coating oven, a primer oven, and/or an enamel oven.

8. A method according to claim 1, wherein the heating step is conducted at temperatures ranging from 180° F. to 385° F.

9. A method according to claim 1, wherein the heating step includes at least one cycle, wherein each cycle ranges from 9 to 25 minutes.

10. A method according to claim 1, wherein the aluminum alloy forms at least a portion of a component for an automotive vehicle.

11. A method according to claim 10, wherein the component is a front shock tower, front body hinge pillar, tunnel, rear rail, door inner panel, door mirror bracket, cross car beam, inner torque box, outer torque box, or rear shock mount.

12. A method according to claim 1 including piercing the cast aluminum alloy without forming a hole in the aluminum alloy prior to the piercing step.

13. A method according to claim 12, wherein the piercing step is conducted prior to the heating of the cast aluminum alloy.

14. A method according to claim 1, wherein the coating includes an epoxy.

15. A method according to claim 1, wherein the coating is applied by electrodeposition.

16. A method according to claim 1 including melting the aluminum alloy prior to the casting step;

trimming, piercing, deburring, grinding, cutting, and/or machining the aluminum alloy after the casting step;

wherein the heating step includes curing the coating on the cast aluminum alloy after the trimming, piercing, deburring, grinding, cutting, and/or machining step.

17. A method according to claim 1, wherein the cast aluminum alloy has an elongation of at least 8% prior to the heating of the cast aluminum alloy.

* * * * *